US006547704B2

(12) United States Patent
Parrillo

(10) Patent No.: US 6,547,704 B2
(45) Date of Patent: Apr. 15, 2003

(54) MUSCLE STRETCHING APPARATUS

(76) Inventor: John Parrillo, 4690 K Interstate Dr., Cincinnati, OH (US) 45246

( * ) Notice: Subject to any disclaimer, the term of this patent is extended or adjusted under 35 U.S.C. 154(b) by 0 days.

(21) Appl. No.: 09/783,512

(22) Filed: Feb. 14, 2001

(65) Prior Publication Data

US 2001/0034289 A1 Oct. 25, 2001

Related U.S. Application Data

(60) Provisional application No. 60/182,976, filed on Feb. 16, 2000.

(51) Int. Cl.[7] ..... A63B 21/06
(52) U.S. Cl. ..... 482/94
(58) Field of Search ..... 482/93–97, 112–113, 482/148, 908, 94–104, 136–138; D21/195

(56) References Cited

U.S. PATENT DOCUMENTS 6,350,219 B1 * 2/2002 Hobson ..... 482/97
6,443,877 B1 * 9/2002 Hoecht et al. ..... 482/103
6,447,430 B1 * 9/2002 Webb et al. ..... 482/98

OTHER PUBLICATIONS

WYNMOR Catalog, Husker Power Rack, Double Half Rack Model # 538601 and Combo Power Station Model # 538501.*

* cited by examiner

*Primary Examiner*—Nicholas D. Lucchesi
*Assistant Examiner*—Lori Baker Amerson
(74) *Attorney, Agent, or Firm*—Theresa Fritz Camoriano; Guillermo Camoriano; George Morgan

(57) ABSTRACT

A muscle stretching apparatus comprising a frame with adjustable extremity grips, a fulcrum, adjustable leg braces, and leg support assemblies with padded rollers, lever handles that allow an aide to push upward providing additional stretching assistance. The apparatus further comprises an adjustable frame which comprises lever handles.

A human with lower extremities on the fulcrum and arm extremities on the extremity grips, by a combination of pushing, pulling, or pushing and pulling, can accomplish a variety of stretching exercises.

19 Claims, 20 Drawing Sheets

FIG. 8
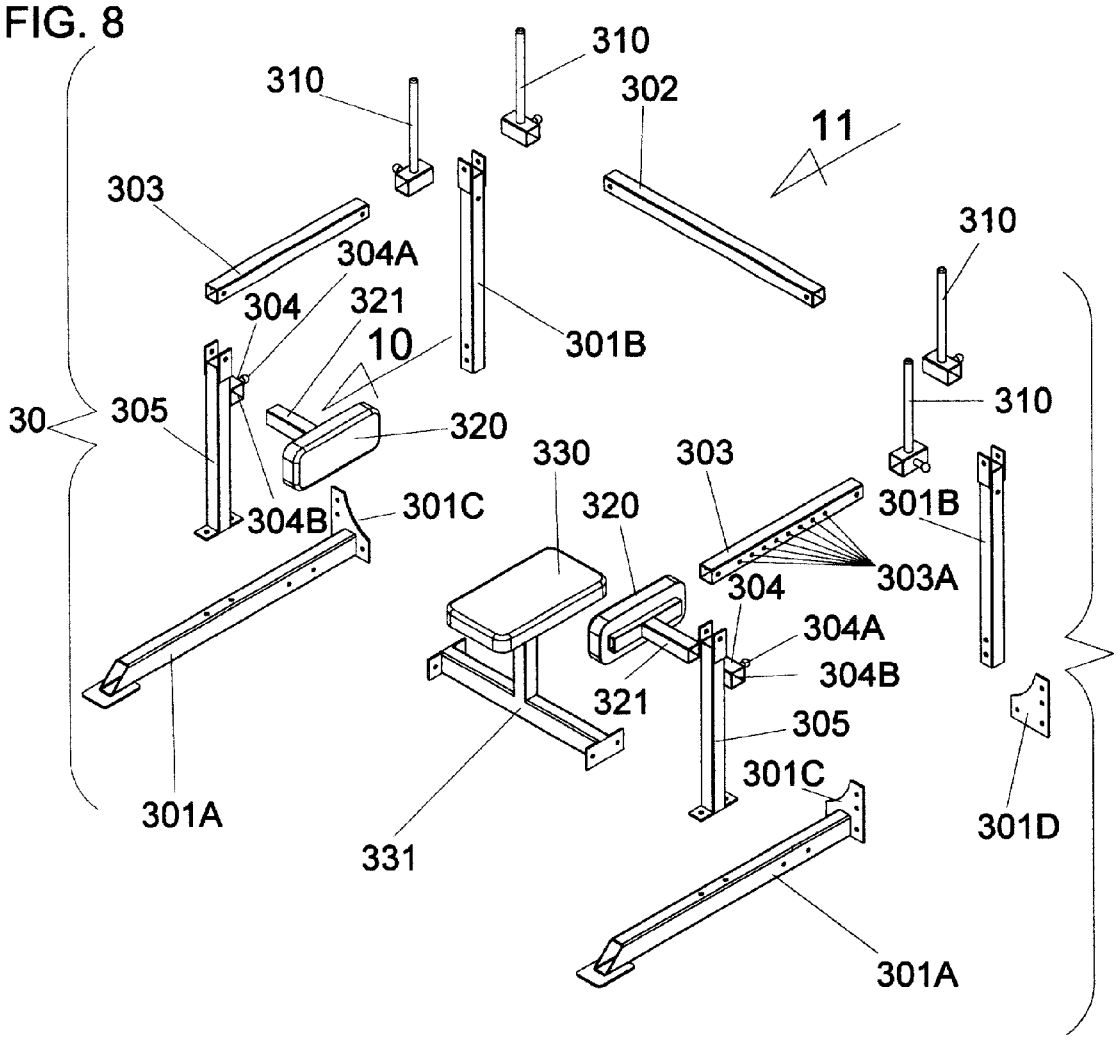
FIG. 9
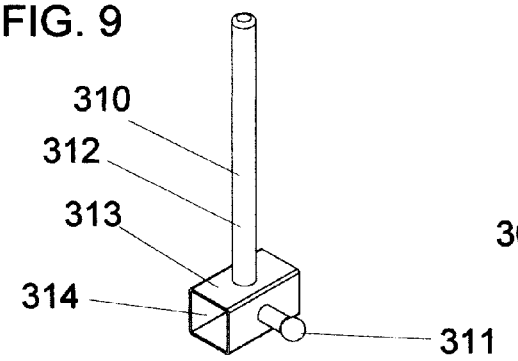
FIG. 10
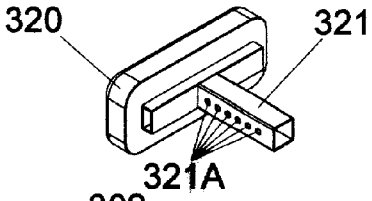
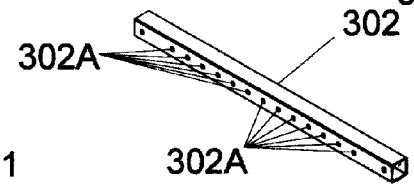
FIG. 11

FIG. 15
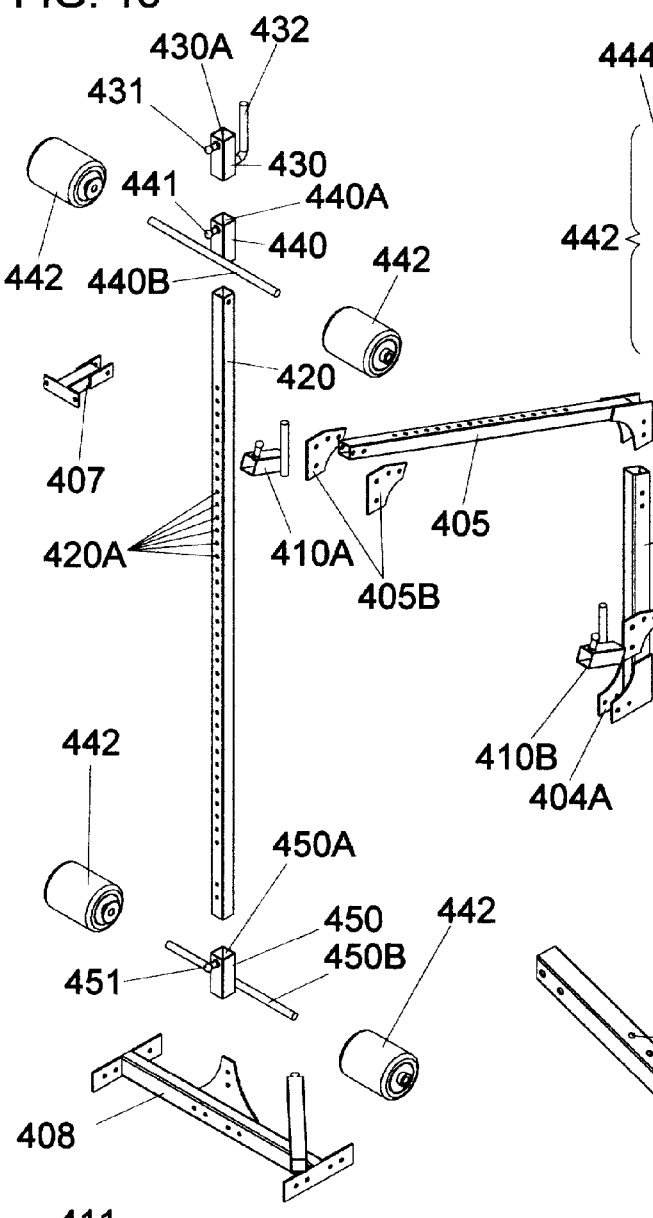
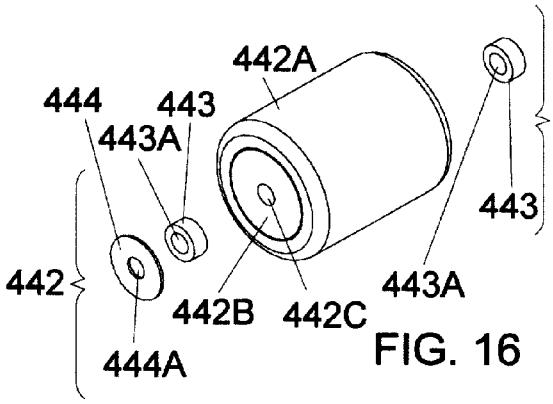
FIG. 16
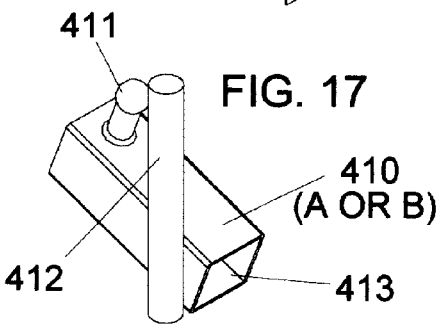
FIG. 17
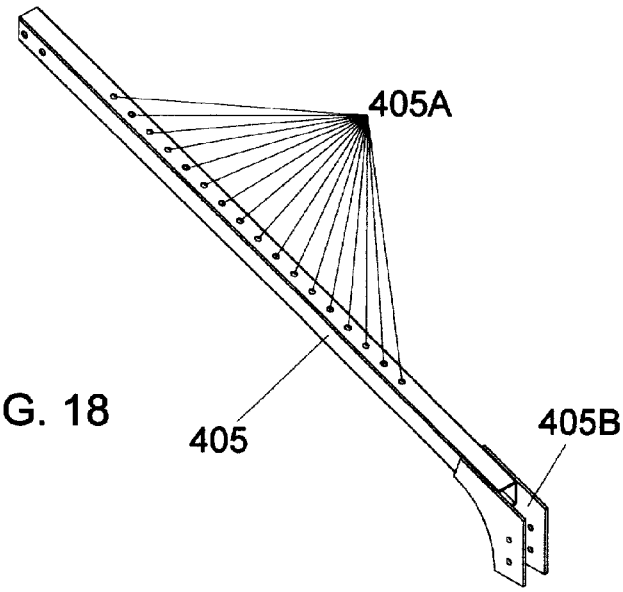
FIG. 18

MUSCLE STRETCHING APPARATUS

This application claims priority from U.S. Provisional Application S. No. 60/182,976 filed on Feb. 16, 2000, which is hereby incorporated by reference.

Statement as to Rights to inventions made under Federally sponsored research and development: Not applicable.

BACKGROUND OF THE INVENTION

1. Field of the Invention

The present invention is a muscle stretching apparatus which is helpful to body builders developing their muscles.

2. Background Information

People trying to develop their muscles, such as, but not restricted to athletes including body builders are into all sorts of equipment and exercises to develop muscle tone and strength. Of equal, but often neglected, importance is proper muscle stretching. While there seems to be an abundance of apparatus for developing muscles, there is an absence of apparatus for stretching muscles.

This applicant, being aware of the dearth of muscle building equipment, and unable to find such equipment, invented his own.

As will be seen from the subsequent description, the preferred embodiment of the present invention overcomes the deficiences of existing exercise apparatus, especially in achieving the intended purpose of the preferred embodiments of the present invention, muscle stretching.

SUMMARY OF THE INVENTION

The preferred embodiment of the present invention is a muscle stretching apparatus comprising a frame, with extremity grips, and a fulcrum that permit a person to stretch appropriate muscles as required. Alternate embodiments comprise adjustable extremity grips, adjustable leg braces, and a leg rest assembly with padded rollers. The preferred embodiment further comprises an adjustable frame which comprises lever handles, and an adjustment handle positioning pin wherein the adjustable frame is bearing supported within, and rotateable to a desired orientation with respect to, said muscle stretching apparatus, wherein said lever handles, when not locked in a given orientation, can be pushed upward by an aide to provide additional stretching assistance.

BRIEF DESCRIPTION OF THE DRAWINGS

FIG. 8 illustrates the muscle stretching exercise station 30 of the present invention.

FIGS. 9, 10, and 11 illustrate additional details from FIG. 8.

FIG. 15 is an exploded view of the muscle stretching exercise station 40.

FIGS. 16, 17, and 18 illustrate additional details from FIG. 15.

DESCRIPTION OF THE PREFERRED EMBODIMENTS

FIGS. 1, 2, 3, and 4 are alternate views of the preferred embodiment of the present invention, a muscle stretching apparatus 1 which comprises muscle stretching exercise stations 10, 20, 30, and 40.

Figure 12:
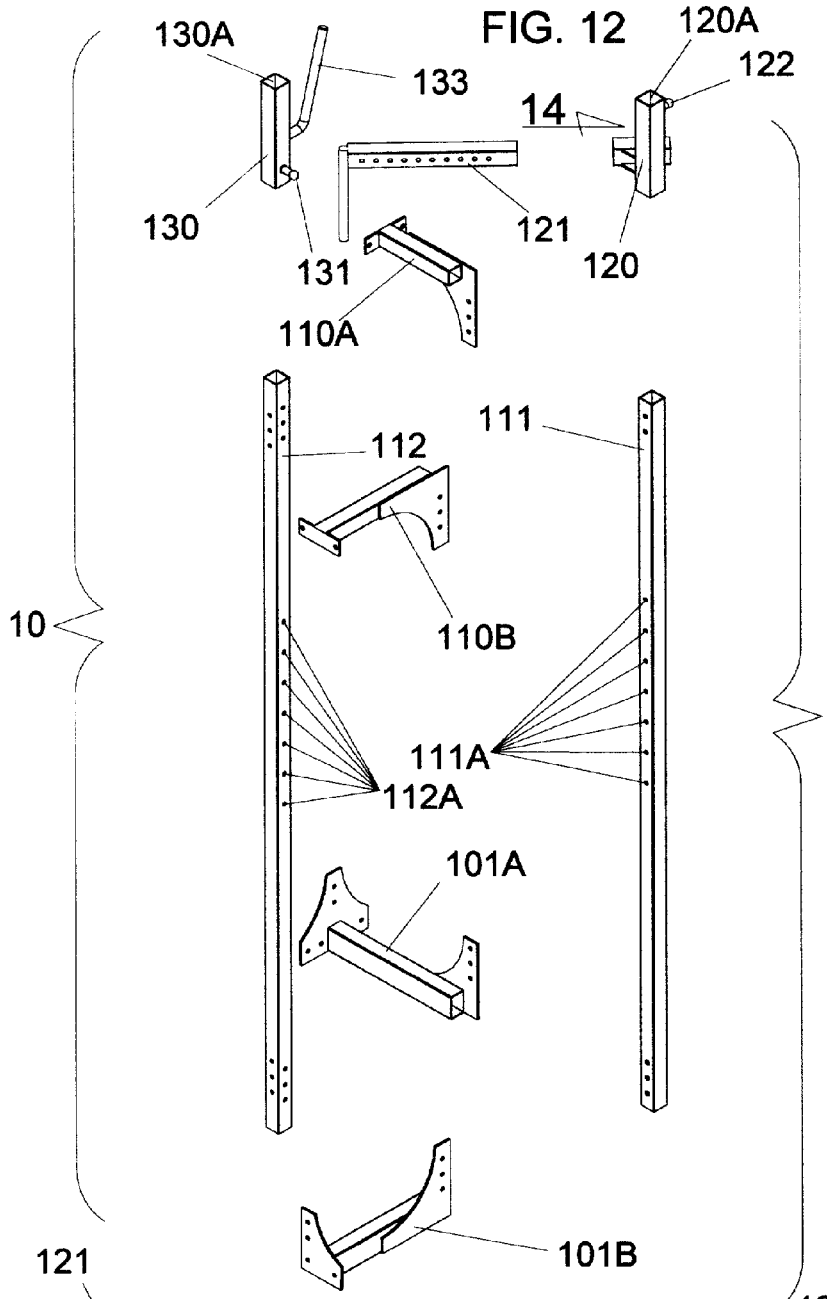
FIG. 12 is an exploded view of the muscle stretching exercise station 10.

Referring to the muscle stretching exercise station 10 shown in FIGS. 1, 2, 3, and 4, which comprises a handle subassembly 10A and a handle subassembly 10B, is shown in an exploded view in FIG. 12 as further comprising a first bottom strut 101A, a second bottom strut 101B, a first top strut 110A, a second top strut 110B, a left frame upright 111, a right frame upright 112, a handle assembly 121, a left handle mount 120, and a right handle mount 130.

As shown in FIG. 12, the left handle mount 120 comprises a left frame upright clearance 120A and a left handle mount positioning pin 122. Said pin 122 is also shown in FIG. 14.

As shown in FIG. 12, the right handle mount 130 comprises a right frame upright clearance 130A, a placement pin 131, and a right handle 133.

Figure 13:
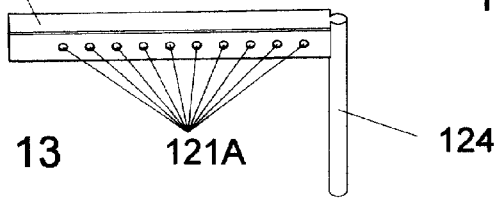
FIGS. 13 and 14 illustrate additional details from FIG. 12.

As shown in FIG. 13, the handle assembly 121 comprises a handle 124 and pin clearances 121A.

Figure 14:
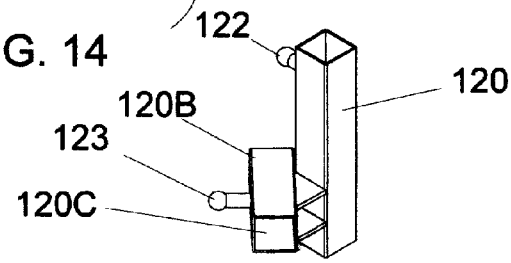

As shown in FIG. 14, The left handle mount 120 further comprises a handle assembly support 120B with a handle assembly clearance 120C and a handle assembly locating pin 123.

Figure 1:
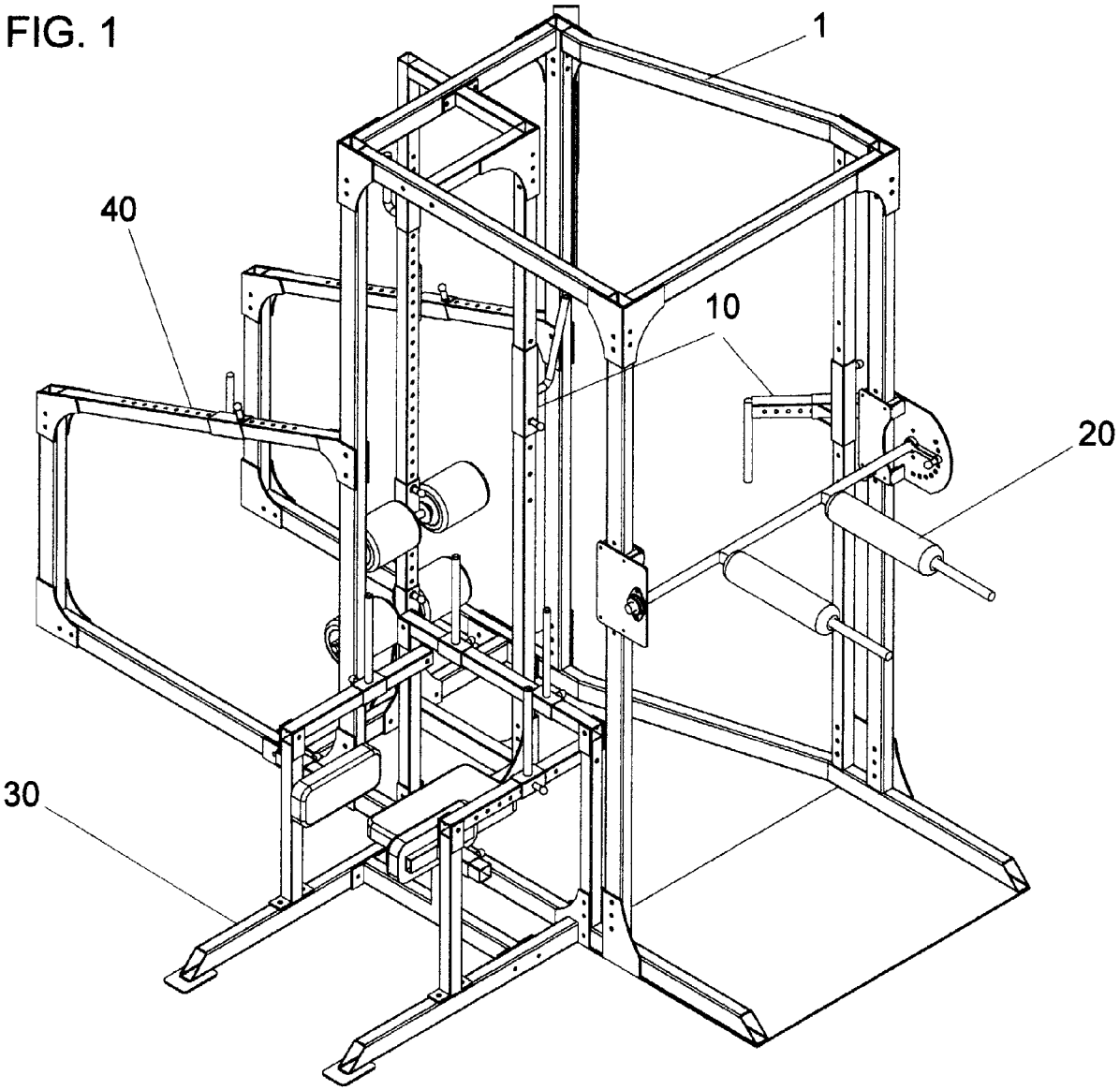
FIGS. 1, 2, 3, and 4 are alternate views of the preferred embodiment of the present invention, a muscle stretching apparatus which combines muscle stretching exercise stations 10, 20, 30, and 40.
Figure 2:
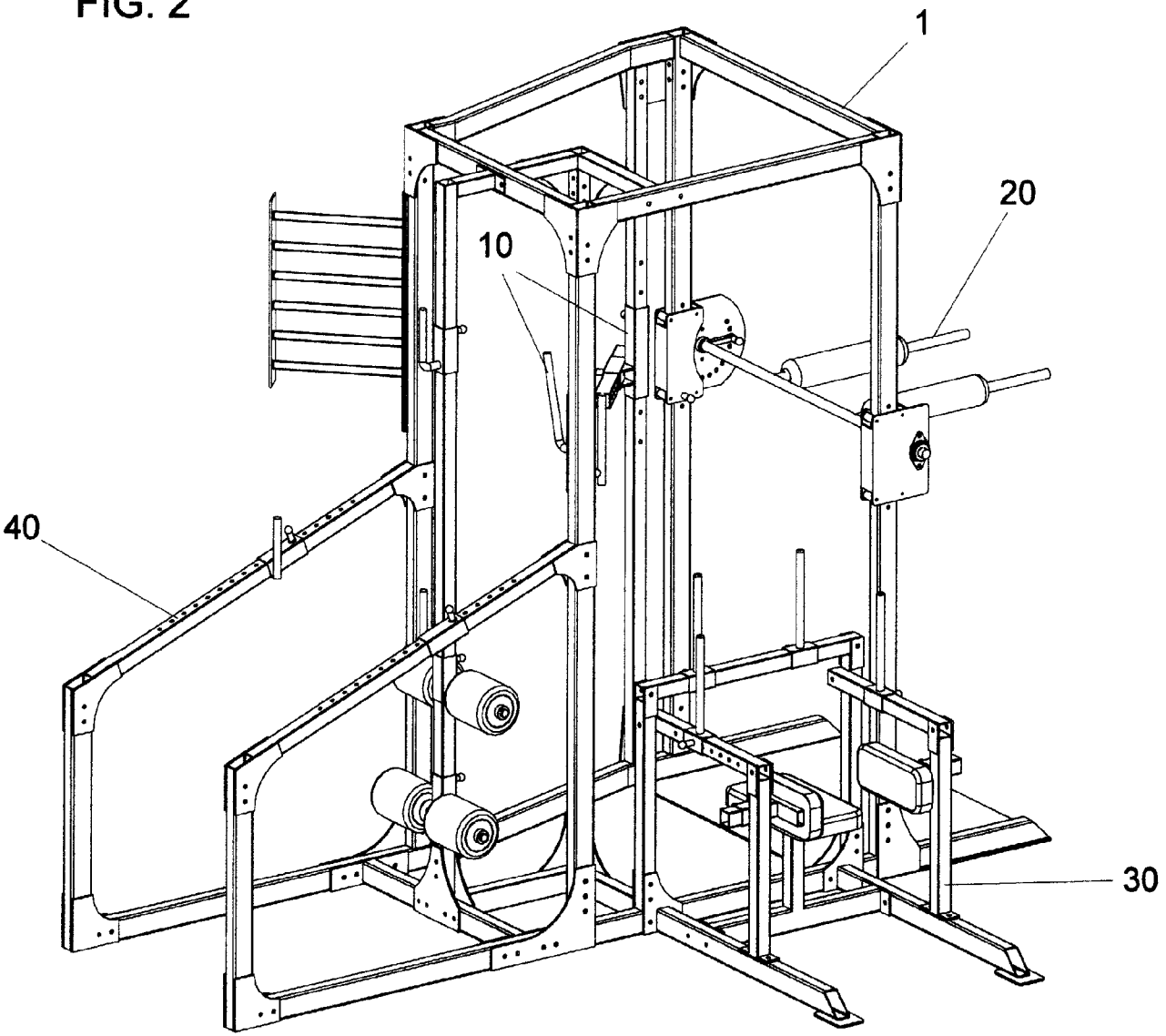
Figure 3:
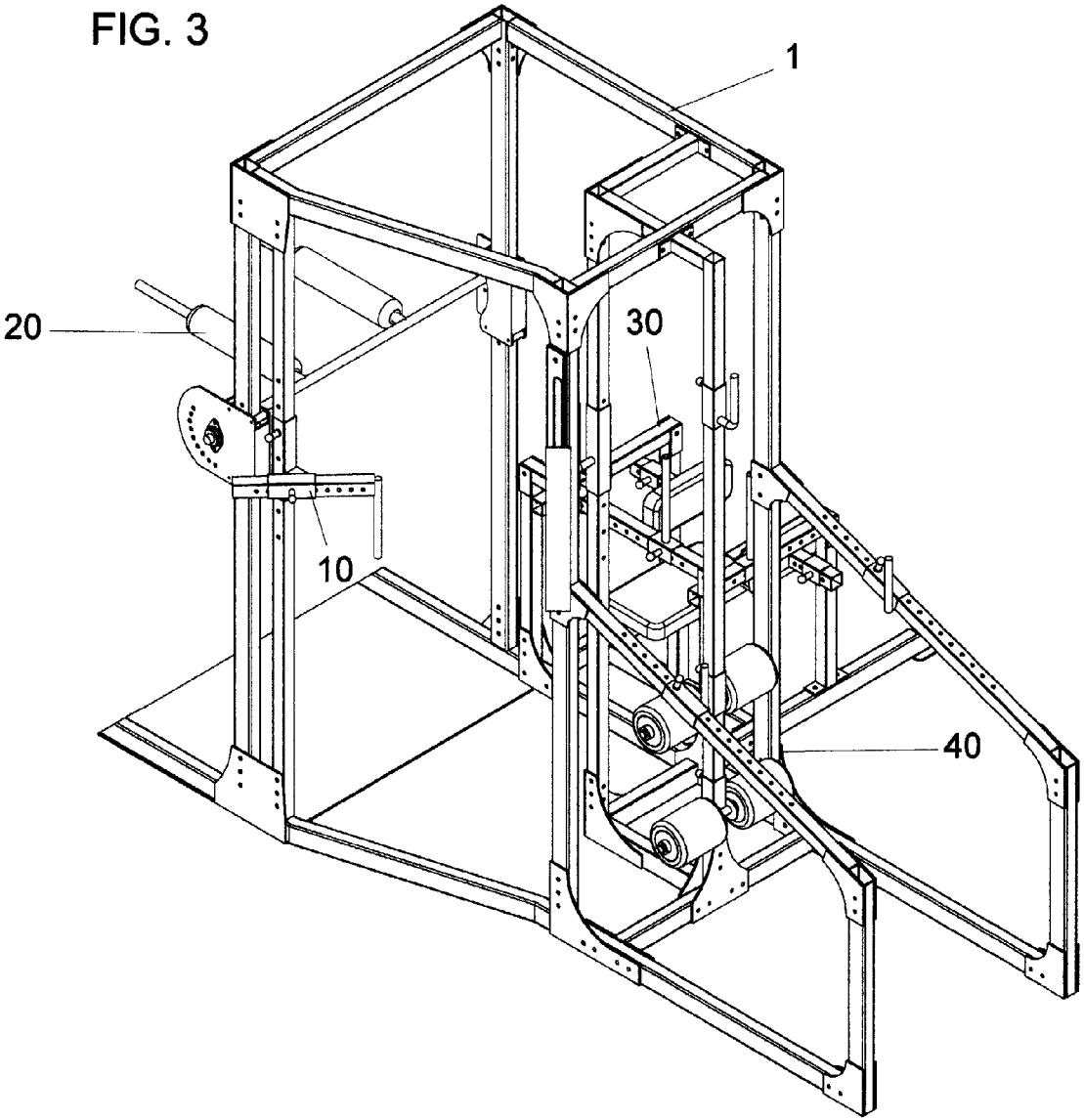
Figure 4:
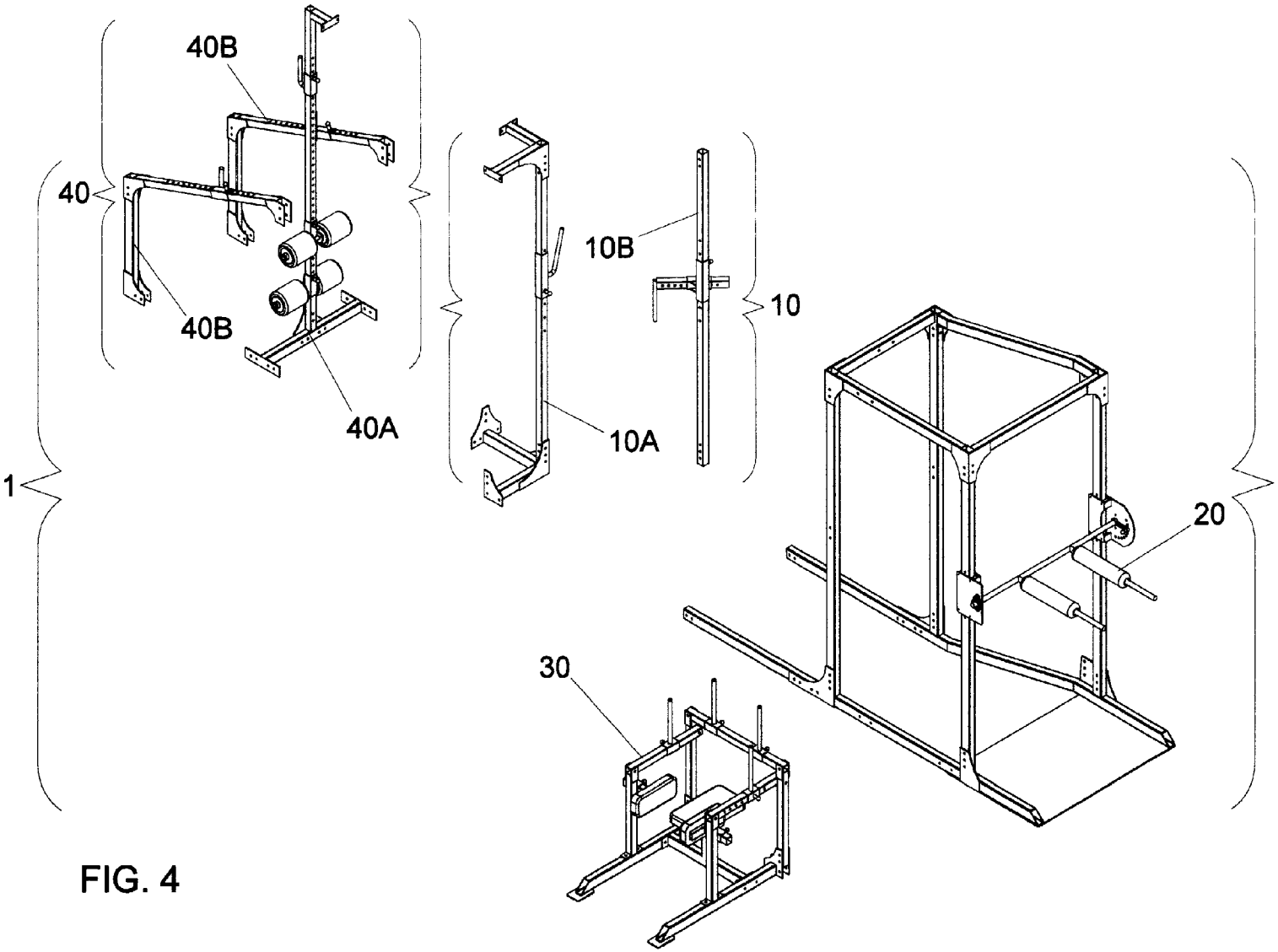
Figure 5:
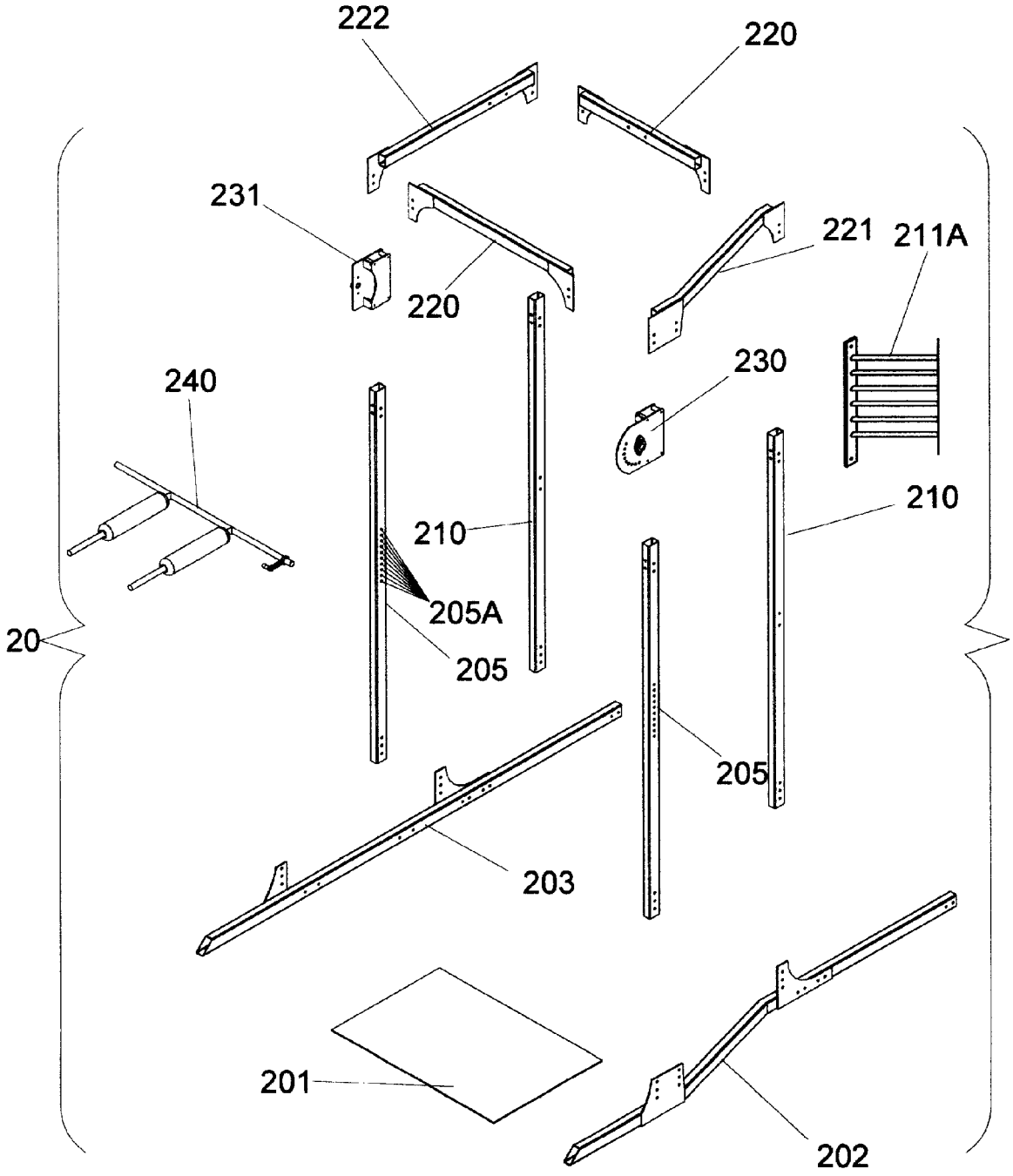
FIGS. 5 and 6 illustrate the muscle stretching exercise station 20 of the present invention.

For purposes of description of the muscle stretching exercising station 20, from FIGS. 1 through 4, some of said station 20 is shown on FIG. 5. Portions of said station 20 are shown in FIG. 6 as an upright assembly 20A and as an adjustable frame assembly 20B in FIG. 7.

Figure 6:
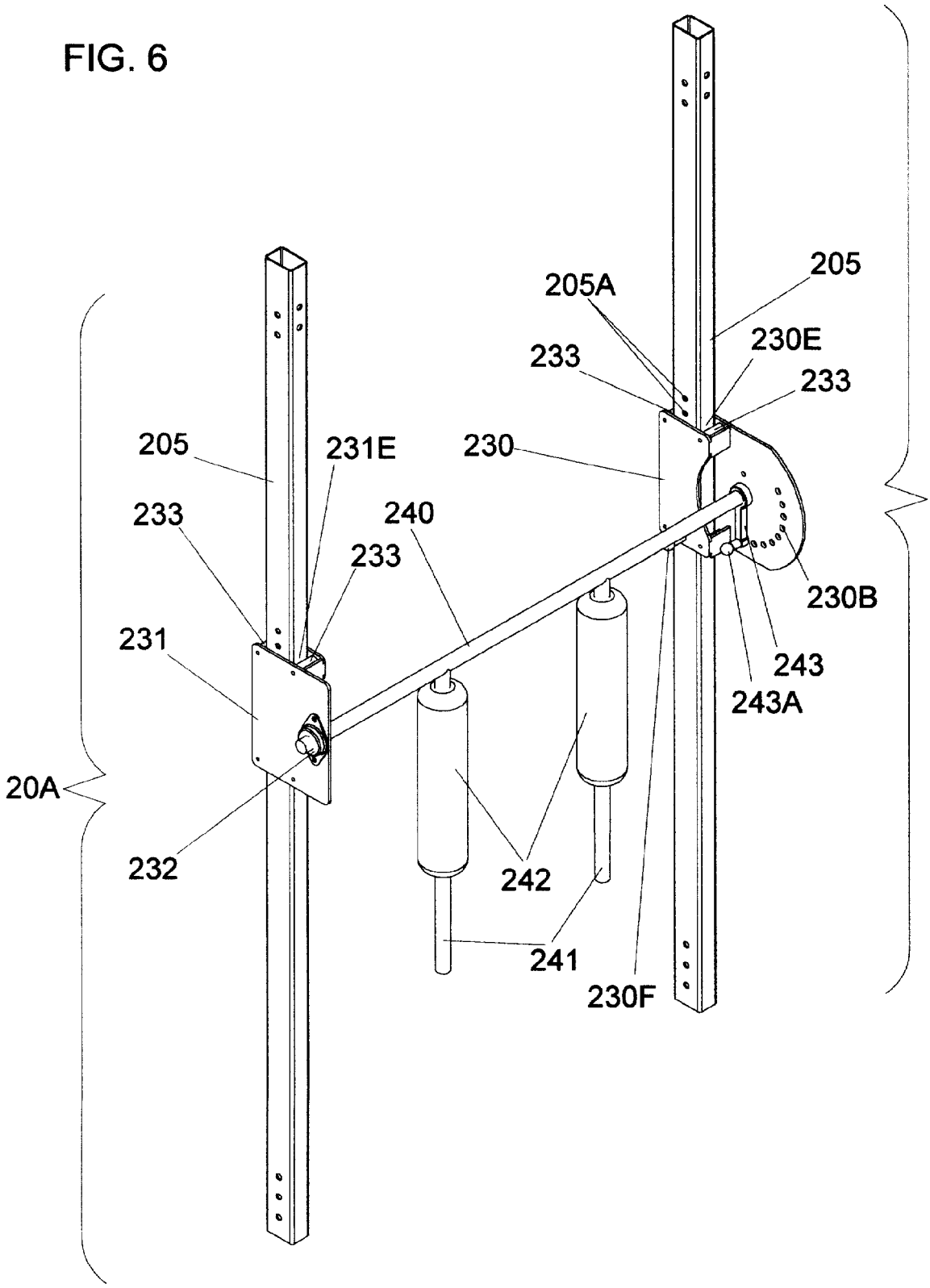
Figure 7:
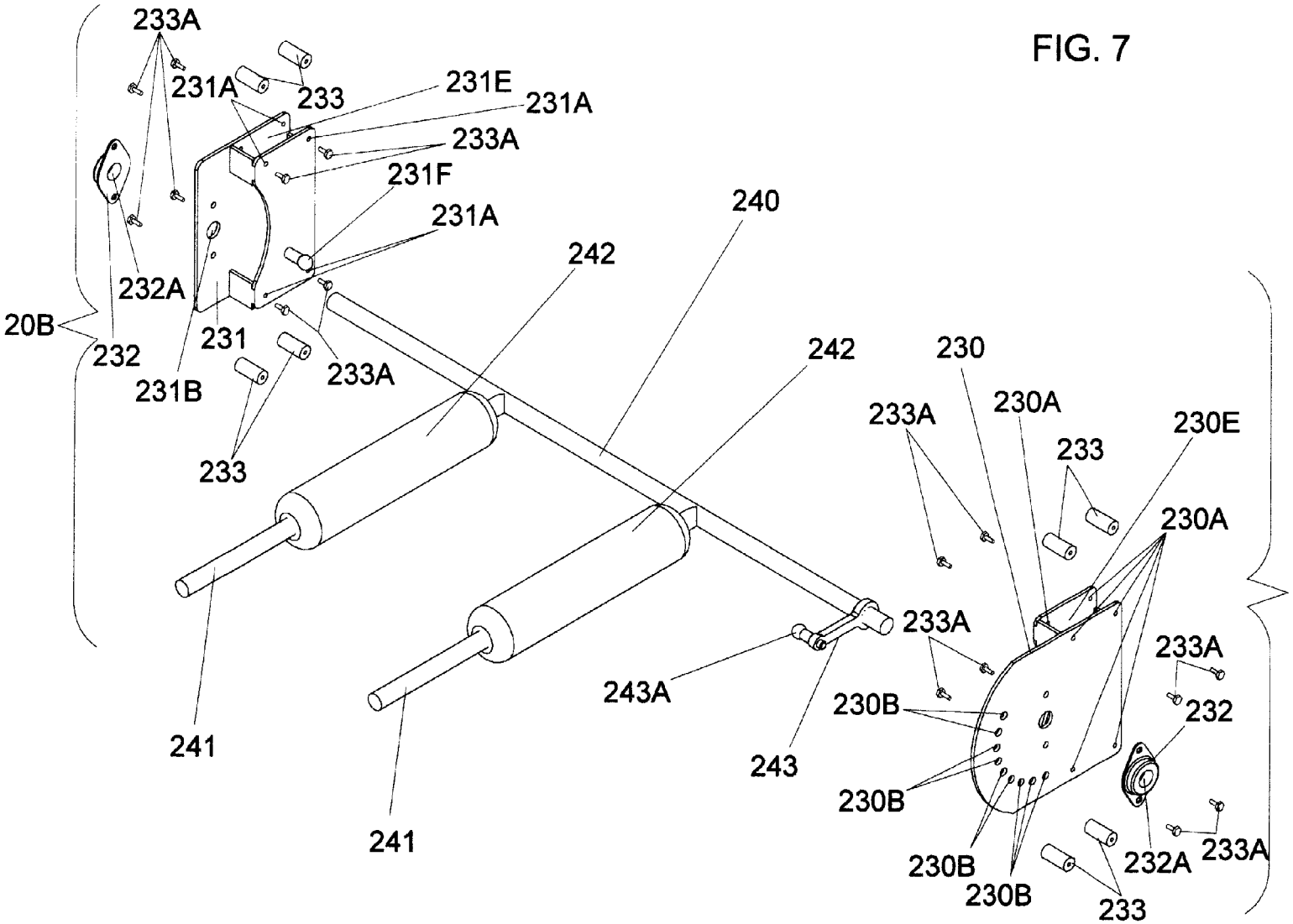
FIG. 7 illustrates additional details from FIGS. 5 and 6.

Referring to FIGS. 5, 6, and 7, said station 20 comprises an upright assembly 20A (Ref. FIG. 6), a base plate 201, a first base support 202, a second base support 203, rear uprights 210, a bar assembly 211A, a first top frame element 220, a second top frame element 221, and a third top frame element 222.

Shown in FIG. 5 are front uprights 205 which are comprised within the upright assembly 20A shown in FIG. 6. Similarly, an adjustable frame 240, an adjuster mount 230, and a mount 231 are shown in FIG. 5 although they are a part of the adjustable frame assembly 20B shown in FIG. 7 which is also a part of the upright assembly 20A shown in FIG. 6.

The upright assembly 20A comprises the front uprights 205, the adjuster mount 230, the mount 231, mount support bearings 232, rollers 233, roller support bolts 233A, and the adjustable frame 240.

The front uprights 205 further comprise positioning pin clearances 205A.

The adjustable frame assembly 20B comprises the adjuster mount 230, the mount 231, the mount support bearings 232, the rollers 233, the roller support bolts 233A, and the adjustable frame 240.

The adjustable frame 240 comprises handles 241 with padding 242, and an adjustment handle 243 with an adjustment handle positioning pin 243A.

The adjuster mount 230 comprises adjuster mount roller bolt clearances 230A, positioning pin clearances 230B, an adjuster mount support bearing clearance 230C, an adjuster mount upright clearance 230E, and an adjuster mount positioning pin 230F.

The mount 231 comprises mount roller bolt clearances 231A, a mount support bearing clearance 231B, a mount upright clearance 231E, and a mount positioning pin 231F.

Each of the mount support bearings 232 further comprises a mount support bearing clearance 232A.

FIGS. 1 through 4, 8, 9, and 10 illustrate the muscle stretcher station 30, comprising support struts 301A, vertical supports 301B, a gusset 301D, a back bar 302, arm rests 303, leg brace mounts 305, sliding handle assemblies 310, leg braces 320, and a seat mount 331 further comprising a seat 330.

Each of the support struts 301A further comprise a strut gusset 301C.

The back bar 302 further comprises positioning pin apertures 302A.

Each of the arm rests 303 further comprise arm rest clearances 303A.

Each of the leg brace mounts 305 comprises a shaft supports 304 which comprises a shaft support clearance 304B and a shaft position retention pin 304A.

Each of the sliding handle assemblies 310 further comprise a sliding handle positioning pin 311, a sliding handle 312, and a sliding handle housing 314.

Each of the leg braces 320 further comprise a shaft 321 which comprises shaft positioning pin clearances 321A.

The seat 330 comprises a seat mount 331.

FIGS. 1 through 4 and 15 through 18 illustrate the muscle stretching station 40 which comprises a left slideable handle assembly 410A, a right slideable handle assembly 410B, frame posts 404, handle support frames 405, a mount bar upper frame mount 407, a cross brace 408, a vertical mount bar 420 with vertical mount bar apertures 420A, a vertical slideable handle assembly 430, a first leg support 440, a second leg support 450, and leg rest roller assemblies 442.

Each of the frame posts 404 comprise frame post gussets 404A.

Each of the handle support frames 405 comprise handle support apertures 405A and gussets 405B.

Each of said handle assemblies 410A and 410B comprise a support frame positioning pin 411, a frame positioning handle 412, and a handle support frame clearance 413.

Each of said handle assemblies 410A and 410B are slideable along said handle support frames 405 and can be fixed in position with respect to said handle support frames 405 by means of said pins 411 in said apertures 405A in said handle support frames 405.

The vertical slideable handle assembly 430 comprises a vertical slideable handle clearance 430A, a vetical slideable handle assembly positioning pin 431, and a hand grip 432.

The first leg support 440 comprises a first leg support clearance 440A, a first leg support bar 440B, and a first leg support positioning pin 441.

The leg support roller assemblies 442 each comprise padding 442A, leg support roller 442B, leg support roller aperture 442C, roller support bearings 443 with roller support bearing clearances 443A, and washers 444 with washer clearances 444A.

The second leg support 450 comprises a second leg support clearance 450A, a second leg support bar 450B, and a second leg support positioning pin 451.

Figure 19:
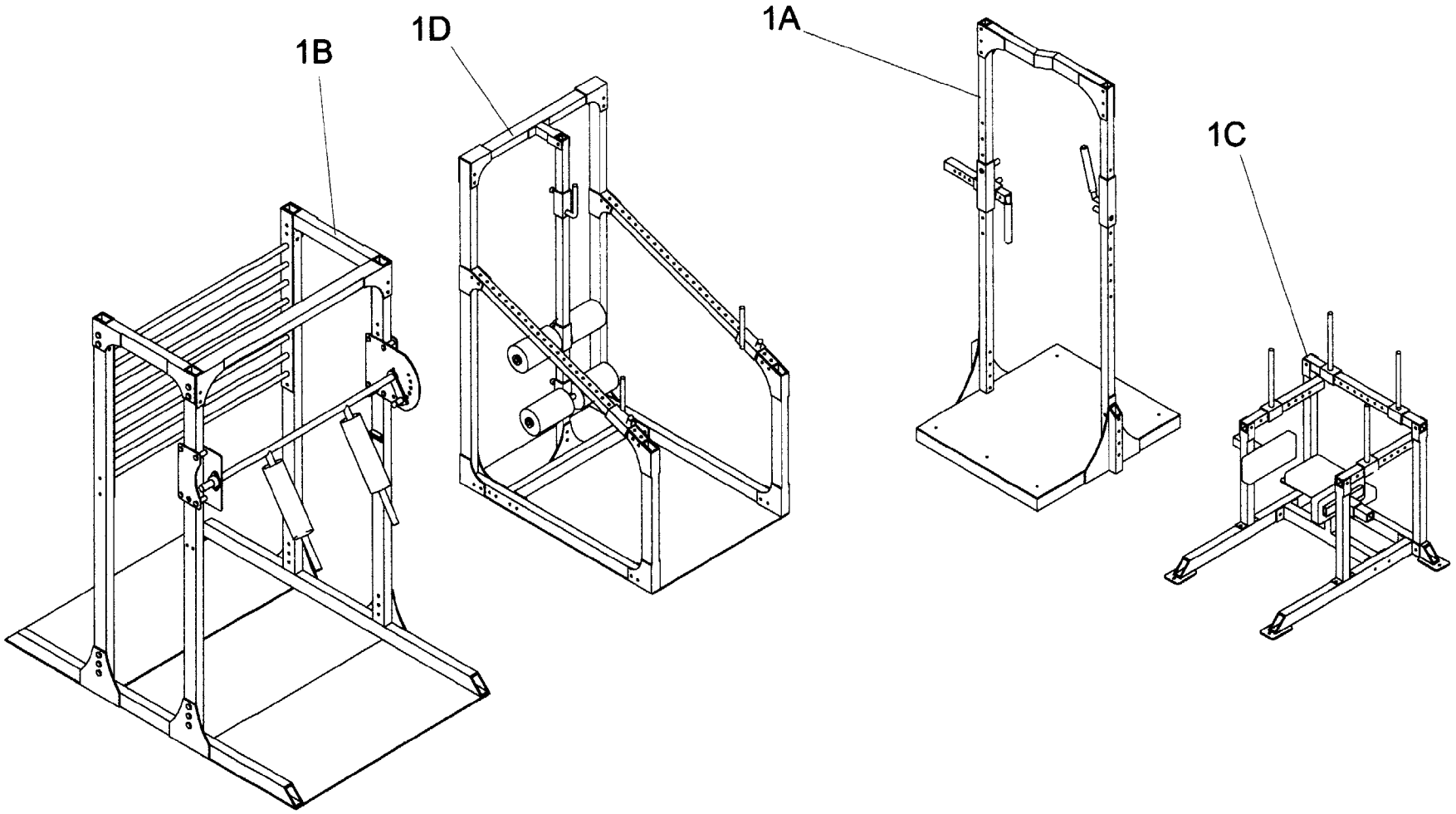
FIG. 19 illustrates alternate embodiments to the preferred embodiment of the present invention, the muscle stretching apparatus from FIGS. 1, 2, 3, and 4. The alternate embodiments are free standing units as opposed to being elements of one apparatus, as shown in FIGS. 1, 2, 3, and 4.

Alternate embodiments of the present invention are shown in FIG. 19 as muscle stretcher 1A, an alternate muscle stretcher 1B, a chair embodiment muscle stretcher 1C, and a second alternate muscle stretcher 1D, which were described in the provisional application for patent referenced in this application.

The preferred embodiment combines said stretchers 1A, 1B, 1C, and 1D into the preferred embodiment of the present invention, said apparatus 1 which comprises said stations 10, 20, 30, and 40.

Said stretcher 1A corresponds to said station 10.

Said stretcher 1B corresponds to said station 20.

Said stretcher 1C corresponds to said station 30.

Said stretcher 1D corresponds to said station 40.

An object and advantage of the preferred embodiment, said apparatus 1 over the alternate embodiment comprising said stretchers 1A, 1B, 1C, and 1D is combining all the alternatives and saving floor space, which is desirable.

Figure 20:
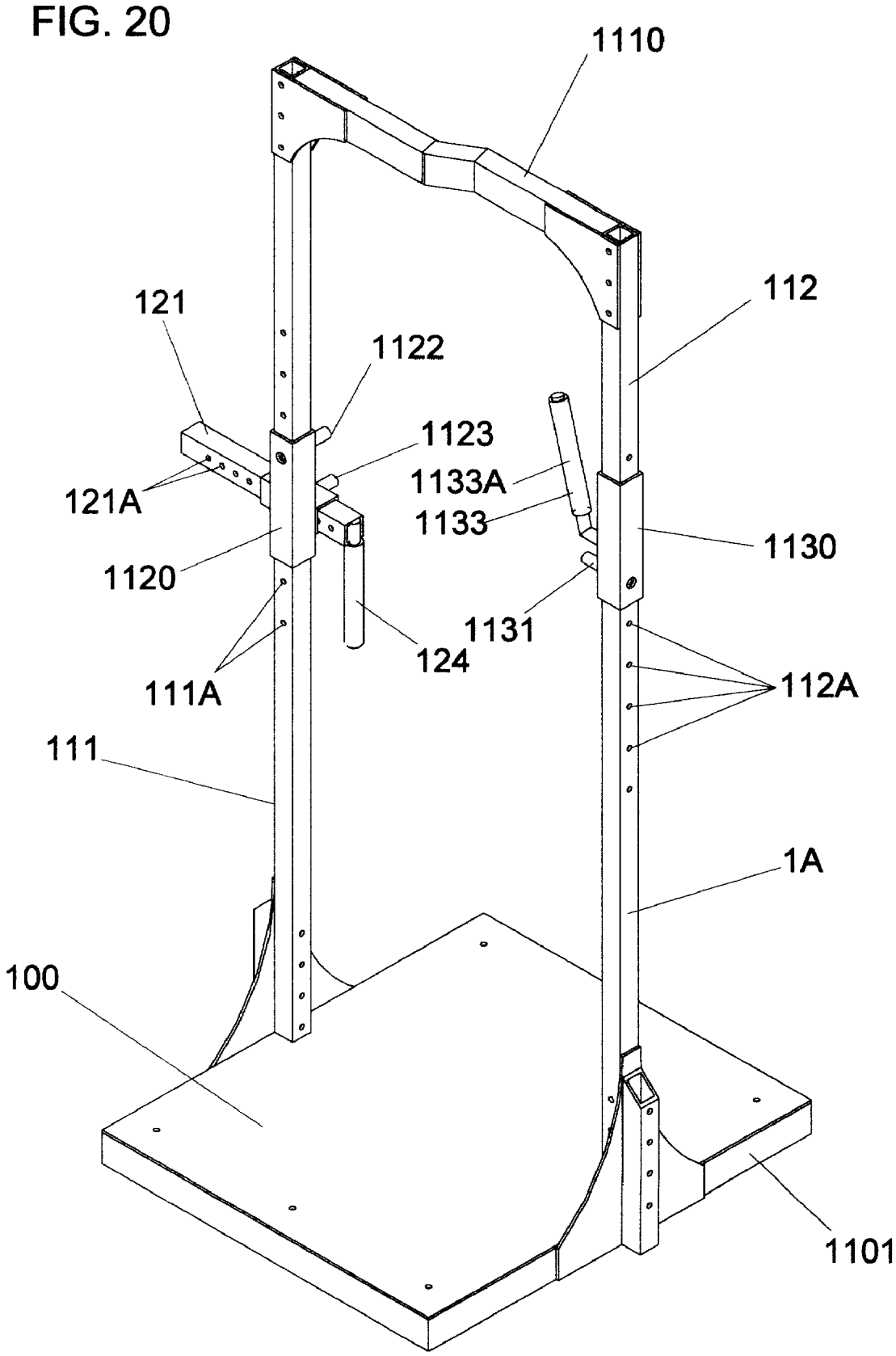
FIG. 20 is a muscle stretcher with adjustable extremity grips which is an alternate embodiment of said station 10.
Figure 21:
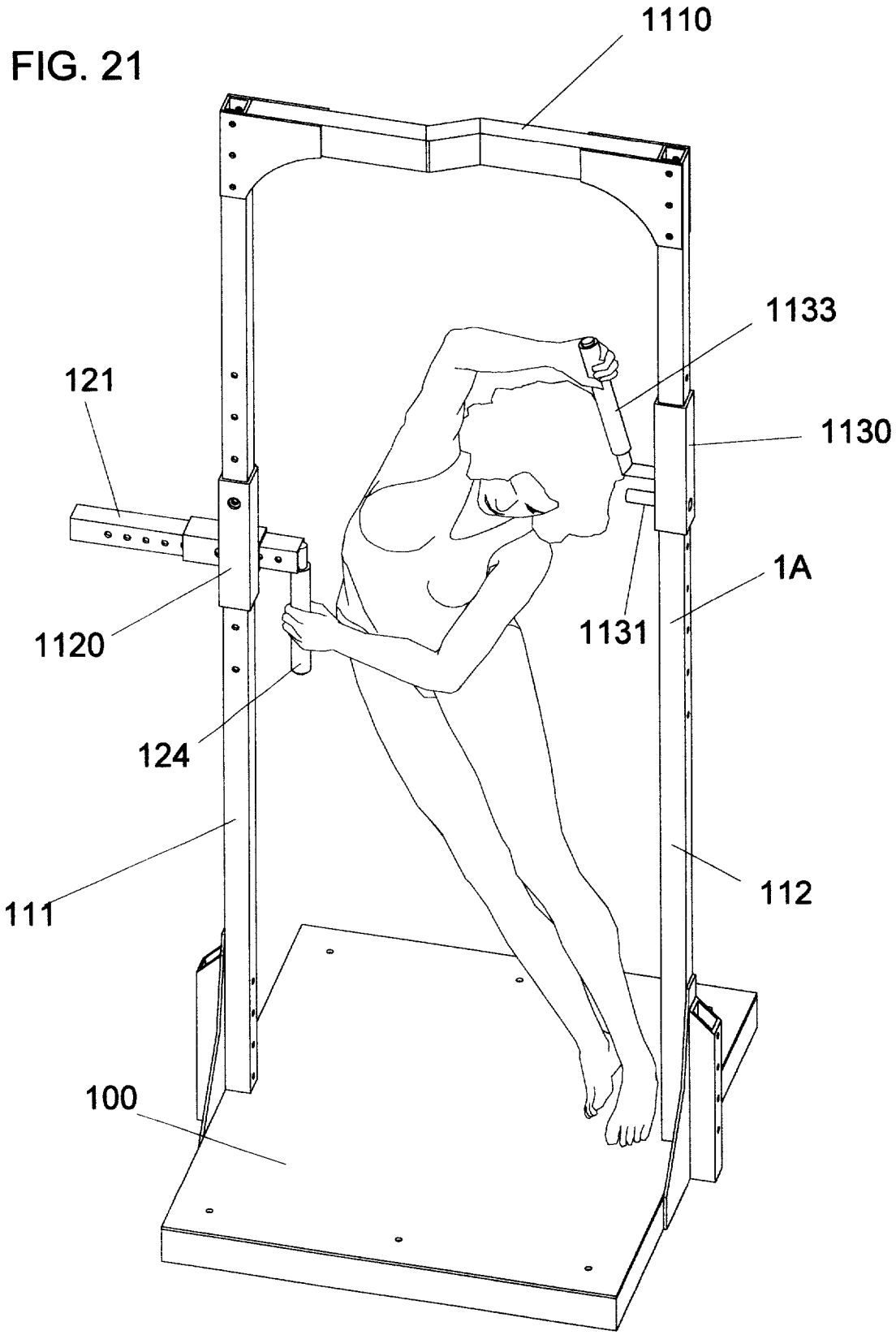
FIG. 21 illustrates a use of the muscle stretcher with adjustable extremity grips from FIG. 20.

Referring to FIGS. 20 and 21, said stretcher 1A comprises a base plate 100, a stretcher bottom frame 1101, a stretcher top frame 1110, the left frame upright 111, the right frame upright 112, a left stretcher handle mount 1120 (also referred to as a left mounting sleeve 1120), the handle assembly 121 (also referred to as an extension leg 121) a left stretcher handle mount vertical positioning pin 1122 (also referred to as a locking pin 1122), a left stretcher handle horizontal positioning pin 1123 (also referred to as an extension leg mounting pin 1123), a right stretcher handle mount 1130 (also referred to as a right mounting sleeve 1130), and a right stretcher handle mount positioning pin 1131 (also referred to as a locking pin 1131). A left handle grip 124 (also referred to as a gripping leg 124) projects downwardly from one end of the extension leg 121, forming a substantially 90 degree angle between said gripping leg 124 and said extension leg 121, such that said gripping leg is substantially parallel to the left frame upright 111. A right handle cover 1133A (also referred to as a gripping leg 1133A) extends from said right mounting sleeve 1130 at an acute upward angle relative to the right frame upright 112, as shown in FIG. 20. The mounting sleeves 1120, 1130 are slidably mounted over their respective uprights 111, 112, and their respective locking pins 1122, 1131 extend through the respective mounting sleeves 1120, 1130 and respective uprights 111, 112, locking the mounting sleeves 1120, 1130 on their respective uprights 111, 112.

The left frame upright 111 comprises the left frame upright placement pin clearances 111A which permit vertical adjustments of said handle mount 1120 with respect to the left frame upright 111.

The handle assembly 121 comprises a handle 124 and pin clearances 121A which allow said left stretcher handle horizontal positioning pin 1123 to locate the handle assembly 121 in position in said handle mount 1120, permitting a lateral adjustment of the handle 124.

The right frame upright 112 comprises right frame upright placement pin clearances 112A which permit vertical adjustments of said handle mount 1130 with respect to the right frame upright 112.

Said handle mount 1130 comprises a right handle positioning pin 1131, a right handle 1133, and a right handle cover 1133A, Said handle mount 1130 is adjusted vertically along the right frame upright 112 as desired, then pinned in place by means of said pin 1131 through said clearances 112A.

The base plate 100 is affixed to the stretcher bottom frame 1101. Said uprights 111 and 112 are affixed to said bottom frame 1101. The stretcher top frame 1110 is affixed to said uprights 111 and 112 so as to provide structural support to said uprights 111 and 112. Bolting of said uprights 111 and 112 to said frames 100 and 1110 is a preferred embodiment for ease of assembly, disassembly, shipping and storage. As obvious to anyone skilled in the art, other means of affixing could be used, including welding. However, bolting has its advantages.

A human is illustrated using the said stretcher 1A with lower limb extremities fixed in an appropriate position on the base plate 100 and arm extremities griping said handles 124 and 1133. A variety of stretching exercises are attainable by means of the position adjustments of said handles 124 and 1133 previously discussed. Said handles 124 and 1133 serve as adjustible arm extremity grips. Said base plate 100 serves as a fulcrum, providing support for a human's lower extremeities.

How to use and benefit from said stretcher 1A:

One adjusts the right handle 1133 to a preferred height, which should be just proximal to one's head.

One stands in said stretcher 1A, on the base plate 100, with one's body parallel to said uprights 111 and 112, so that one's shoulder and leg touch said upright 112 with the right handle 1133.

One grasps the right handle 1133 with a reverse grip, palm facing forward, keeping feet planted firmly on the base plate 100 with one's weight on the leg closest to the left handle 124.

One leans one's trunk medially while maintaining a firm grip on the right handle 1133.

To stretch further, one grasps the left handle 124 with one's free hand and pulls one's body towards the left handle 124.

By pulling one's trunk, one is creating a force couple, and increasing the stretch on one's muscles. While doing this, one's upper posterior torso muscles will be stretched passively. When a force couple is applied, muscles are stretched actively. By stretching the affected muscles, one reduces the possibility of injury while stretching the fascia overlying the muscles allowing for more growth. Growth comes through increasing one's golgi tendon reflex threshold, and will allow one's muscles to fire more efficiently without shutting down in response to stretched tendons. Other benefits that will follow would be an increase in the separation of the muscles, improved recovery time, and rehabilitation occurring in an environment friendly to the muscles.

The muscles associated with said stretcher 1A are the latissimus dorsi, middle trapezius, lower trapezius, rhomboid major, rhomboid minor, serratus anterior, teres minor, infraspinatis, teres major, and the coracobrachialus. These muscles are in action during extension, adduction, and rotation of the humerus and during upward rotation of the scapula.

The latissimus dorsi muscle is a broad sheetlike muscle located on the posterior side of the torso. It is mostly superficial except for a small portion covered posteriorly by the lower trapezius muscle and distally as it passes through the axilla to attach on the proximal, anterior, and medial surfaces of the humerus. The latissimus dorsi muscle is a strong agonist in extension, adduction and medial rotation on the shoulder because it crosses the shoulder joint inferior and medial to the joint axes.

The middle trapezius muscle originates from the nuchal ligament of the lower cervical vertbra and spinous process of the upper thoratic vertbra and inserts on the medial aspect of the acromion process and along the scapular spine. Its line of pull is horizontal, which makes it affective at scapular retraction. When an arm is adducted overhead, the scapula rotates upward and causes the upper trapezius to lengthen.

The lower trapezius originates from the spinous processes of the middle and lower thoratic vertebra and inserts on the base of the scapular spine. It is a diagonal line of pull, more vertical than horizontal, making it effective in depression and upward rotation of the scapula and only assistive in retraction.

The major and minor rhomboid muscles can be discussed together because functionally they have the same actions and are commonly considered one muscle. These muscles have a geometric shape that is skewed so that their sides have oblique angles. The rhomboid muscles are deep to the trapezius muscles. They originate form the nuchal ligament and spinous processes of C7 through T5 and insert on the vertebral border of the scapula. Because of their oblique line of pull, they have a good horizontal and vertical component and are prime movers in retraction and elevation of the scapula.

The serratus anterior muscle originates on the lateral surface on the upper eight ribs. Unlike the other muscles associated with this stretch, this muscle is on the anterior side of the torso. It attaches on the anterior surface of the scapula along the vertebral border between the superior and inferior angles. The muscle runs posteriorly to pass between the scapula and rib case. Because of its nearly horizontal line of pull outward, it is a prime mover in scapular protraction.

The teres minor is mostly superficial with portions covered by the trapezius and the deltoid muscles. The teres minor muscles originates on the axillary border of the scapula and runs obliquely up and outward to inserts onto the posterior portion of the great tubercle of the humerus. The function of this muscle is lateral rotation and horizontal abduction of the humerus.

The infraspinatis muscle is closely related to the teres minor both anatomically and functionally. The infraspinatus muscle lies below the spine of the scapula. The infraspinatus muscle's distal attachment is just inferior to the attachment of the supraspinatus. This muscle originates from the infraspinous fossa of the scapula and inserts onto the greater tubercle of the humerus. Functionally, the infraspinatus is effective during lateral rotation and horizontal abduction of the humerus.

The teres major muscle has it proximal attachment on the axillary border just below the teres minor muscle. The teres major muscle travels with the latissimus dorsi muscle through the axilla, to where they attach close together on the anterior medial surface of the humerus near the proximal end. The teres major muscle is a prime mover in extension, adduction, and medial rotation of the shoulder complex.

The last muscle involved is the coracobrachialis muscle. This muscle has an almost vertical line of pull quite close to a shoulder joint axis. Most of the generated force is directed back into the joint, thus stabilizing the head of the humerus against the glenoid fossa. The coracobrachialis originates form the process of the scapula and inserts onto the medial surface of the humerous near the midpoint.

This movement affects the shoulder joint. Most muscles from the torso attach or insert on or around the shoulder complex. The degrees of range of motion should be 180 degrees of flexion, 60 degrees of extension, 180 degrees of abduction, 70 degrees of medial rotation, and 90 degrees of lateral rotation. By maintaining the effective range of motion, injuries will be less frequent and rehabilitation of this joint will be performed more effectively. Said stretcher 1A effectively allows the user to easily maintain this range of motion.

Figure 22:
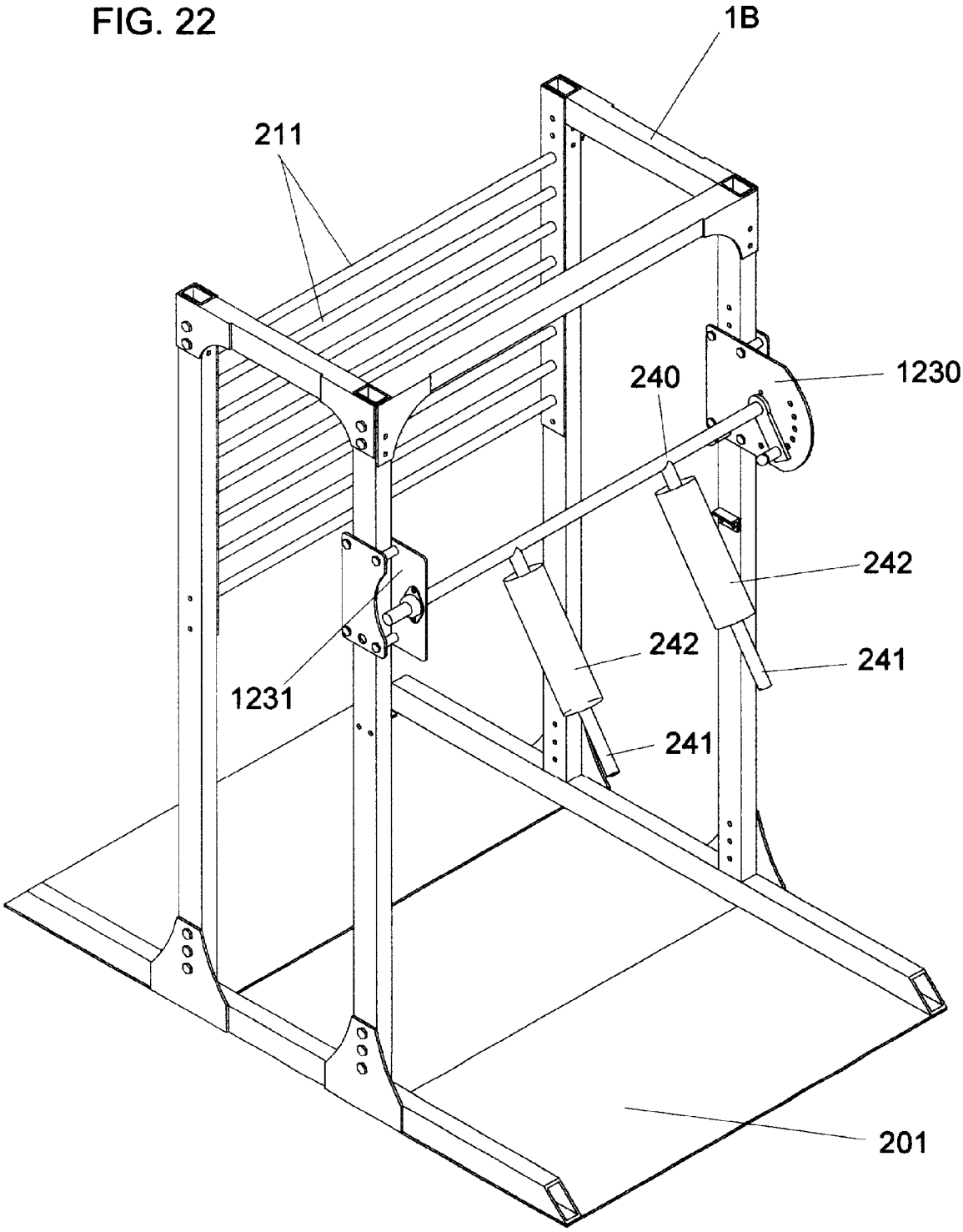
FIG. 22 illustrates a combined alternate muscle stretcher which is an alternate embodiment of said station 20.
Figure 23:
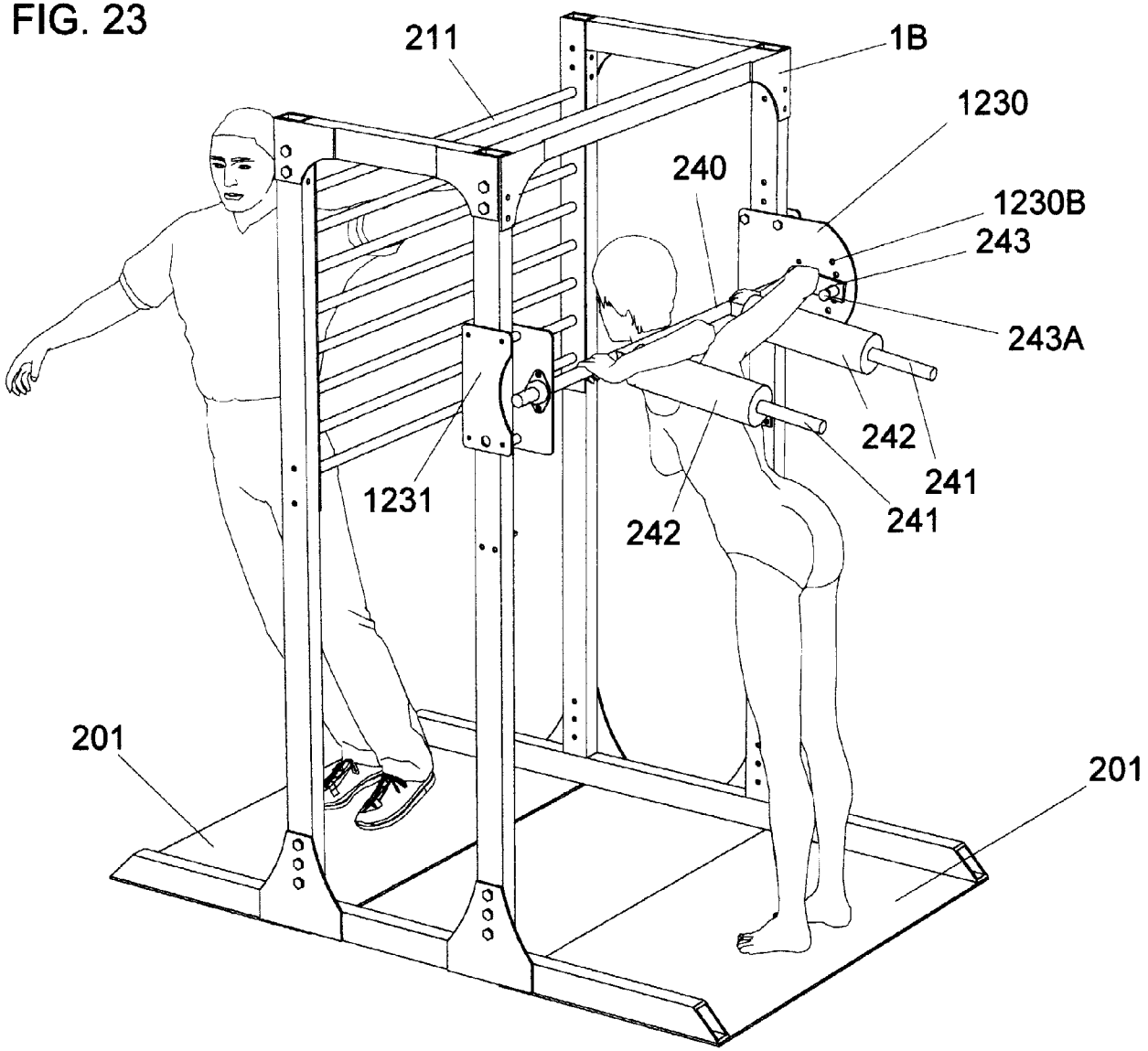
FIG. 23 illustrates some uses of the combined alternate muscle stretcher.

FIGS. 22 and 23 illustrate said stretcher 1B comprising bottom plates 201, the adjustable frame and pivotably mounted axle 240, a right stretcher adjuster mount 1230, and a left stretcher adjuster mount 1231.

Said stretcher 1B further comprises bars 211 (also referred to as extremity grips 211), said bars 211 serving as arm extremity grips, supported at various elevations by said muscle stretcher 1B.

The lever handles 241 are locked in a given orientation by the adjustment handle positioning pin 243A of the adjustment handle 243 placed into a desired stretcher adjuster mount position pin clearance 1230B of said mount 1230.

Humans are shown engaged in stretching exercises in said stretcher 1B in FIG. 23.

A female has her lower extremities, i.e. feet, in a position on one of the bottom plates 201, said bottom plate serving as a fulcrum, supporting her lower extremities, while her arm extremities, i.e. hands, are grasping the adjustable frame 240 with her arms over the padding 242 of the lever handles 241. The lever handles 241 are shown locked in position.

By a variety of combinations of pushing, pulling, and shifting one's weight, a variety of muscles are stretched. For additional stretch, the lever handles 241 are unlocked by removing the adjustment handle positioning pin 243A and by having an aide push upward on the lever handles 241 to provide additional stretching assistance. The adjustable frame 240 serves as an arm extremity grip for the female.

A male has his lower extremities in position on one of the bottom plates 201 with a hand grasping one of the bars 211. This is an example of merely one of the stretching possibilities with said stretcher 1B.

To perform a pec-shoulder stretch on said stretcher 1B, as shown in FIG. 23, face said stretcher 1B. Adjust said frame 240 to shoulder height. One's elbows rest on the padding 242 while one graps said frame 240. One pushes one's body forward, while expanding one's chest cavity. One attempts to keep one's head facing upward while one tries to raise one's sternum. To perform an advanced version of this stretch, have a partner grasp said handles 241 and slowly push upwards.

To perform a tricep stretch on said stretcher 1B, stand facing away from said stretcher 1B. One steps up against said stretcher 1B with one's back against the bars 211. One places an arm behind himself or herself, and grasps one of the bars 211 slightly above shoulder height with a pronating grip, twisting one's lower body away from said arm, so that the biceps are stretched.

Figure 24:
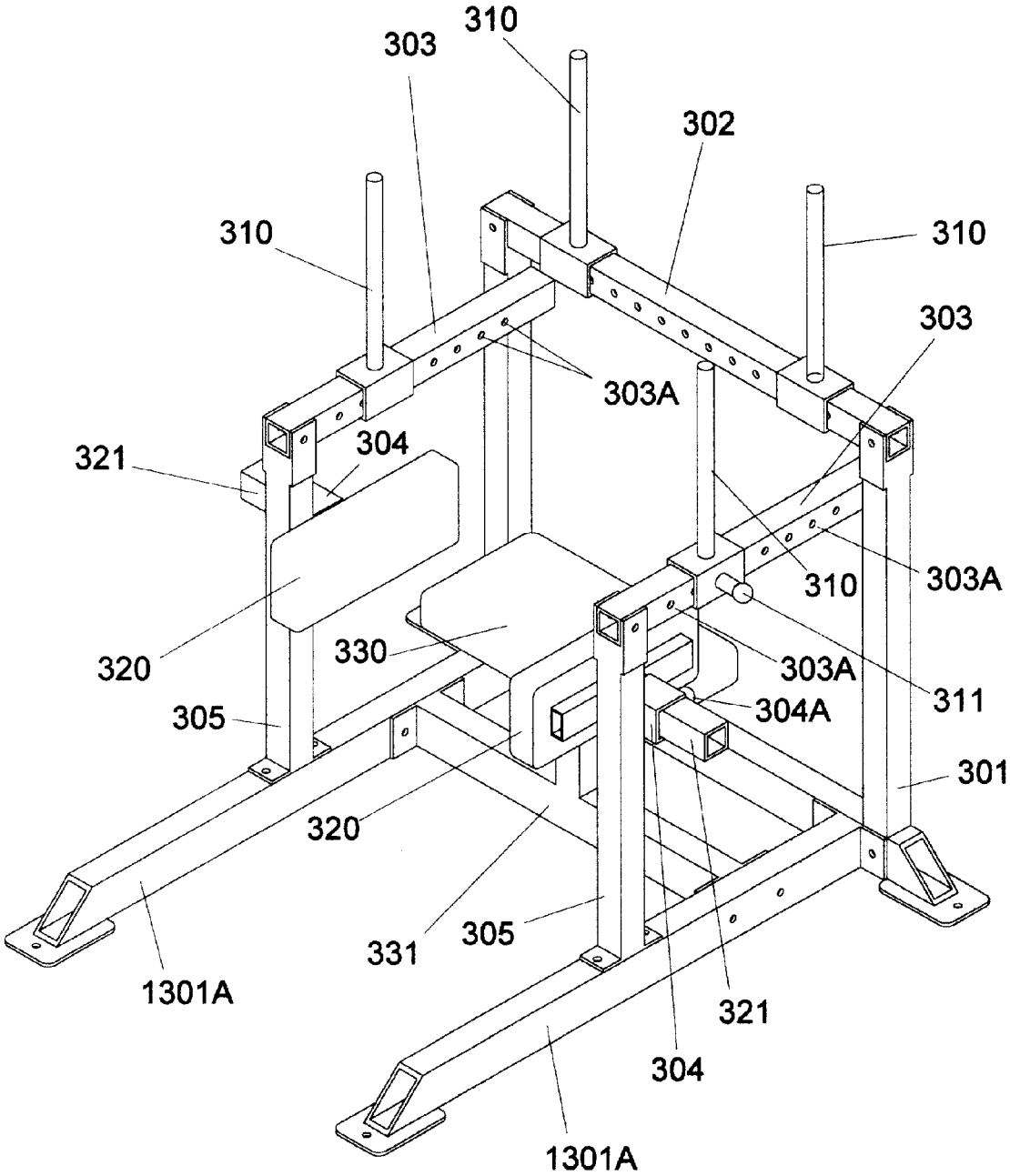
FIG. 24 illustrates a chair embodiment muscle stretcher which is an alternate embodiment of said station 30.
Figure 25:
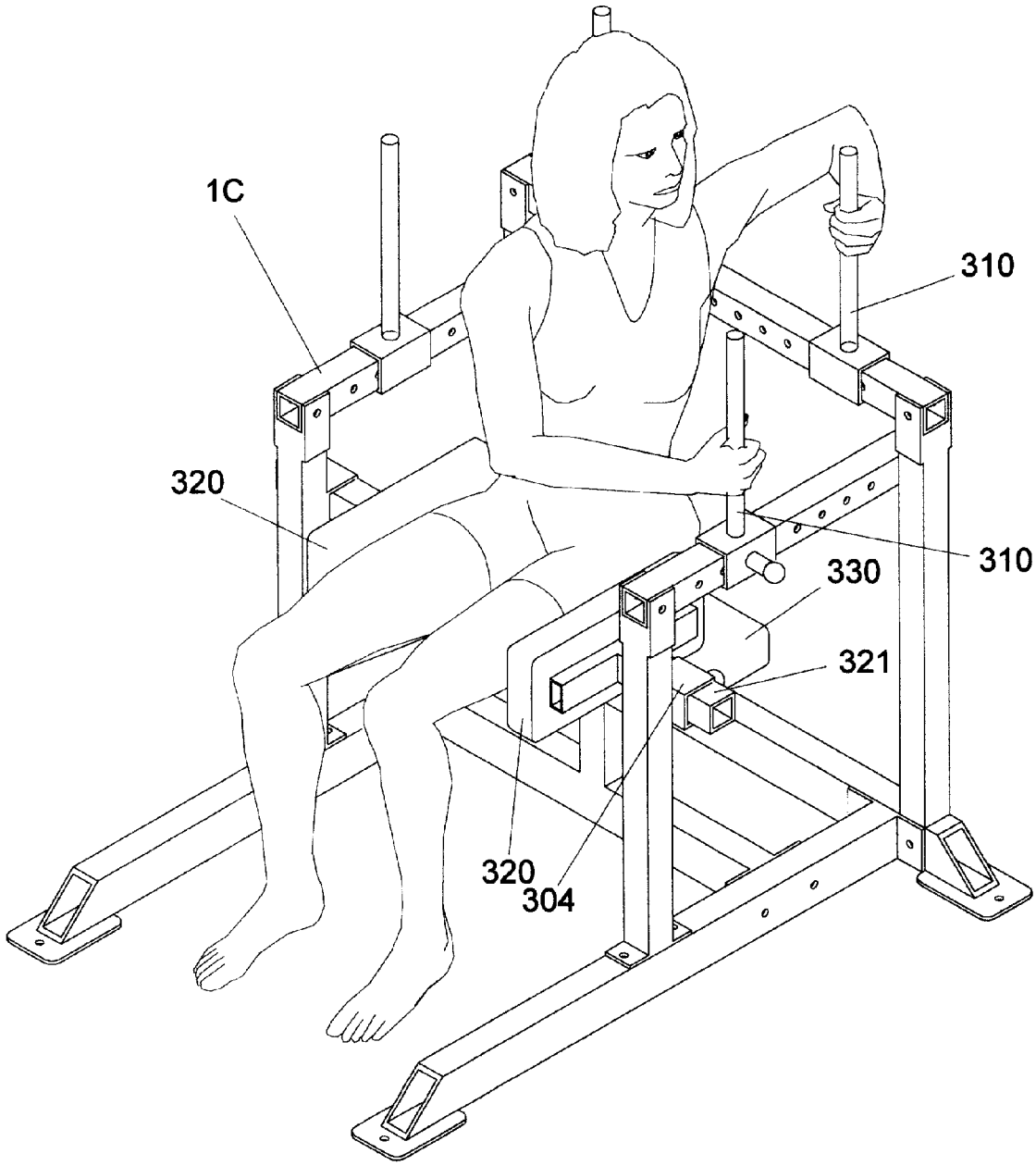
FIG. 25 illustrates a use of the chair embodiment muscle stretcher.
Figure 26:
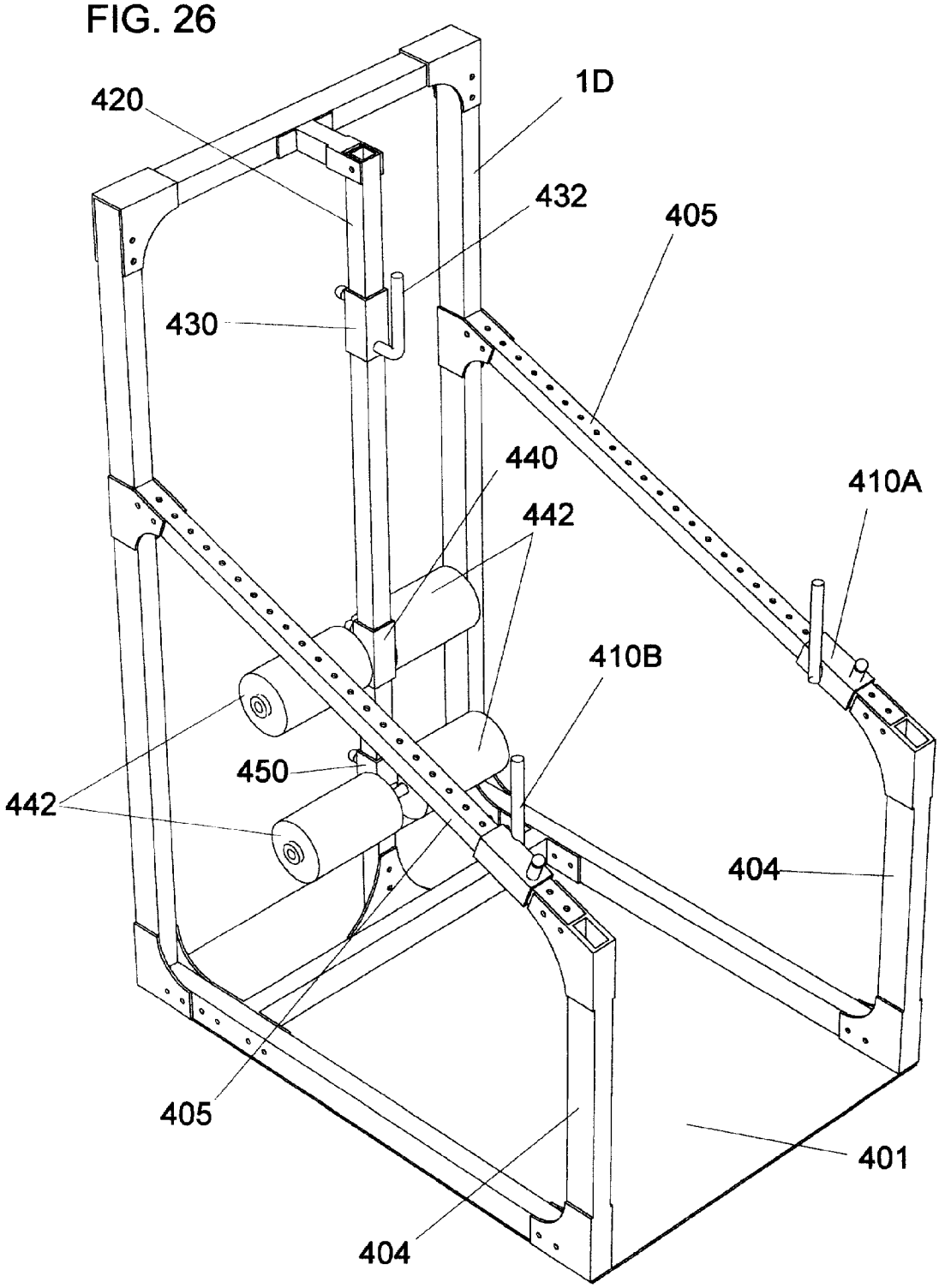
FIG. 26 illustrates a second alternate muscle stretcher which is an alternate embodiment of said station 40.
Figure 27:
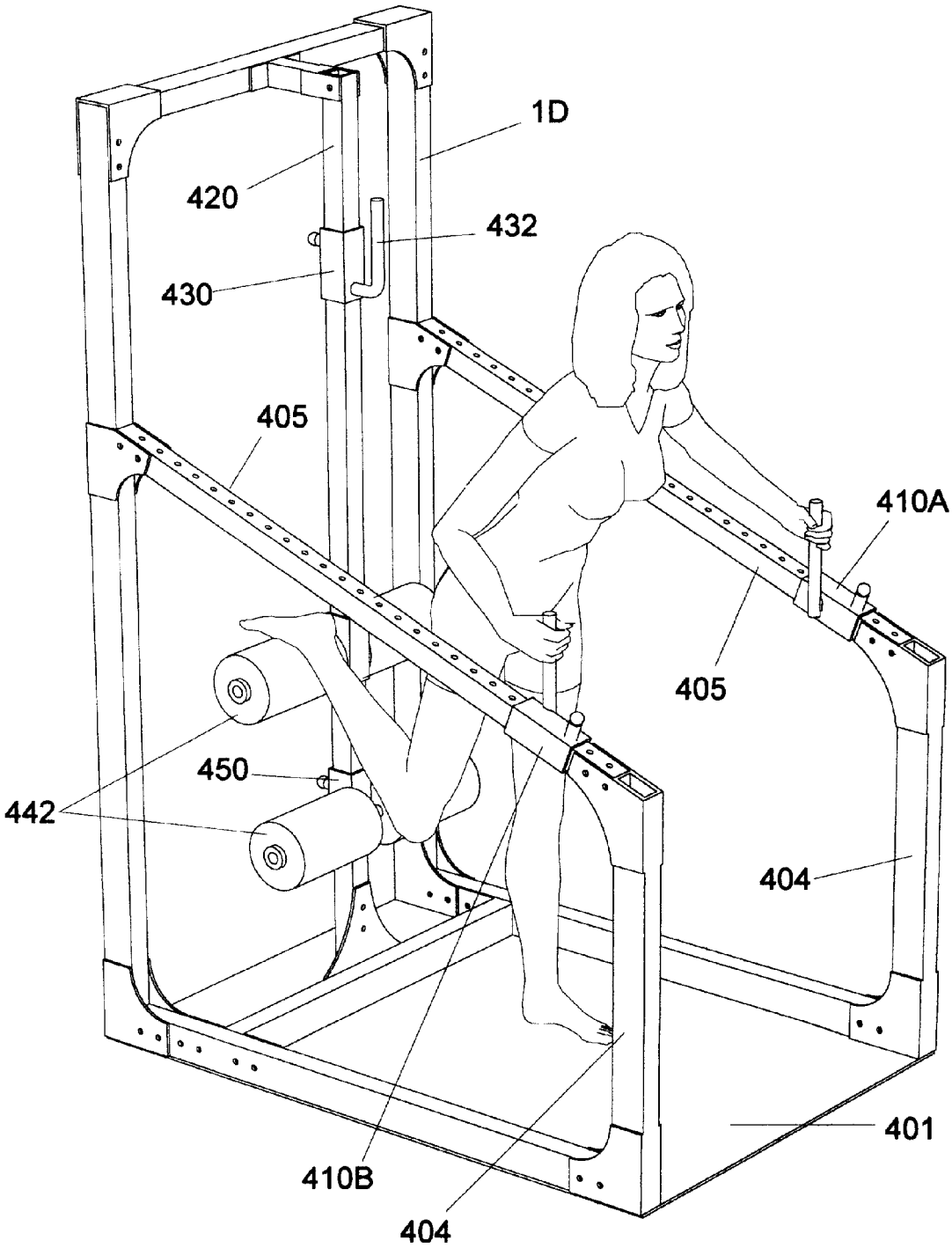
FIGS. 27 and 28 illustrate usage of the second alternate muscle stretcher.
Figure 28:
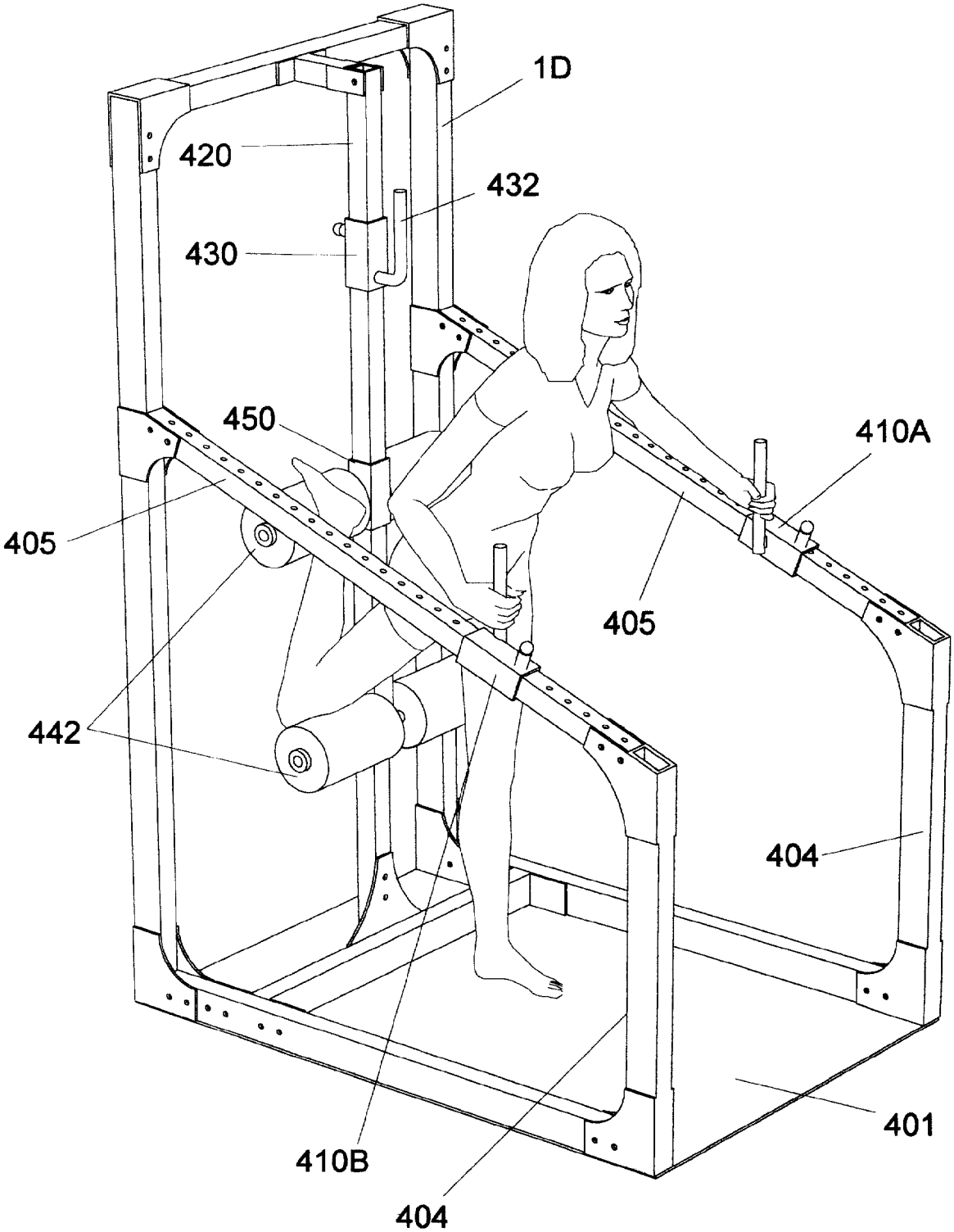

FIGS. 24 and 25 illustrate said stretcher 1C comprising a frame 301 which comprises stretcher frame supports 1301A, the back bar 302 (also referred to as a substantially horizontal member 302), the arm rests 303 (also referred to as substantially horizontal members 303), the leg brace mounts 305 (also referred to as uprights 305), and the seat mount 331; the slidable handle assemblies 310; the leg braces 320; and the seat 330. Refer to FIGS. 8, 9, and 10 for finer details of many of these parts.

The arm rests 303 are shown with arm rest clearances 303A which are also shown in FIG. 8.

Each of the leg brace mounts 305 includes one of said supports 304 (also referred to as leg brace mounting receptacles 304), which are also shown in FIG. 8.

As discussed in the discussion of FIG. 9, each of the sliding handle assemblies 310 includes one of said locking pins 311, although only one of said locking pins 311 is illustrated in FIG. 24. The mounting sleeves 314 (See FIG. 9) are slidably mounted over their horizontal members 302, 303, and their respective locking pins 311 extend through the respective mounting sleeves 314 and respective horizontal members 302, 303, locking the mounting sleeves 314 on their respective horizontal members 302, 303.

In FIG. 25, one of the leg braces 320 is shown with its shaft 321 (also referred to as leg extension 321) labeled, while in FIG. 24 both leg braces 320 are shown with their shafts 321 labeled.

The seat mount 331 connects to the stretcher frame support struts 1301A of the frame 301.

The leg braces 320 mount in said supports 304, which are a part of the leg brace mounts 305. The leg braces 320 are slidable within said supports 304 and pinnable in a desired position by virtue of said positioning pins 304A (also referred to as mounting pins 304A) inserted into said pin clearances 321A, as can be seen from FIGS. 8 and 11.

Each sliding handle assembly 310 serves as an arm extremity grip and comprises said pin 311 so each said handle assembly 310 can be fixed in position by means of said pin 311 in said clearances 303A in the arm rest 303 or in said clearances 302A in the back bar 302 as desired. Refer also to FIGS. 8, 9, and 10.

Said stretcher 1C is boltable to a floor, such as a gymnasium floor, which would serve to support the lower extremites of a human in position for stretching muscles.

A human is shown held in position by the leg braces 320, with lower extremeties in position on a floor, while arm extremities grasp sliding handle assemblies 310. By a combination of pushing and pulling on the sliding handle assemblies 310, which serve as extremity grips, while held in position by the leg braces 320, with feet on the floor, a human can accomplish a variety of muscle stretching exercises.

Referring now to FIG. 25, in operation the user first positions the sliding handle assemblies 310 to a desirable position consistent with the user's size, desired exercise and the users range of motion. In the FIG. 25, the sliding handle assembly 310 behind the user has been positioned such that she must reach around behind and slightly twist the back in order to reach that sliding handle assembly 310. Then, by pushing on the sliding handle assembly 310 behind and pulling on the sliding handle assembly 310 held in her right hand, the user can extend the muscles in her lower back and force her range of twisting motion to increase. The adjustable leg braces 320 can be moved in or out to provide a point that the user can use to balance the net force resulting from the force applied to the two sliding handle assemble is 310. After several repititions, the user can turn and repeat the process on the opposite side, grasping the sliding handle assembly 310 behind with her right hand, and the other sliding handle assembly 310 with her left hand.

To explain the benefits of a seated torso stretch using said stretcher 1C, referring to FIGS. 24 and 25 and a method of obtaining said benefits:

One adjusts said handle assemblies 310 to a preferred location.

One sits in said stetcher 1C with one's back toward the back bar 302.

One adjusts the leg braces 320 on either side of one's legs to a desired position.

One reaches across one's trunk and clutches one of said handle assemblies on one side or the other and pull while at the same time one reaches back with the other hand and grasps the rear handle and pushes. This results in a force couple within the upper torso.

By twisting the upper torso, the posterior muscles in the torso will be stretched passively. When pressure is applied by one's upper extremities, one increases the stretch. When active stretching is applied, muscles will have an increased excursion and an increase in resting length.

Muscles associated with lateral bending, trunk extension, and flexion will be affected using said stretcher 1C. Beginning with the sacrospinalis muscle group, these three muscles run parallel to the vertebral column connecting spinous processes, transverse processes, and ribs. The most medial of this group is the spinalis muscle group and primarily attach to the nuchal ligament and spinous processes of the cervical and thoratic vertebrae. Located at the midline, these muscles are prime movers in trunk extension. When the upper torso is twisted laterally the inferior portion of this muscle group will be stretched and hence have a longer resting length allowing the muscle to relax more efficiently. The next muscle in the sacrospinalis group is the longissimus muscle group. This muscle group is located lateral to the spinalis muscle, attaching the transverse processes from the occiput to the sacrum. These muscles have a vertical line of pull laterally to the midline and thus, laterally bend when contracting unilaterally and extend when contracting bilaterally. The last muscle associated with this group is the iliocostalis muscles, and these are the most lateral of the group. Superiorly, they attach to the transverse processes, and inferiorly they attach to the sacrum and ilium. When contracting unilaterally, they have a lateral bending effect. However, when contracting bilaterally they are effective extensors.

The deepest of the affected muscles is a group of three muscles called the transversospinalis muscle group. This group has an oblique line of pull essentially attaching from a transverse process to the spinous process of a vertebra and thus are very effective at rotation. There are two muscles, within this group, that are considered when using said stretcher 1C. The other is not affected during this movement, primarily because of its superior location on the posterior torso. The two to be discussed are the multifidus and the rotatores. These muscles rotate to the opposite side and extend the spine. During stretching, the benefit of lengthening these muscles will be noticeable relaxation in the lumbar region.

The next set of muscles to consider are located deep and have a vertical line of pull. The names of these muscles are the inerspinales muscles and the intertransversarii muscles. The inerspinales muscles attach from the spinous process inferiorly to the spinous process superiorly throughout most of the vertebral column. Unlike the inerspinales, these muscles are effective at lateral bending.

The last muscle to be directly associated with said stretcher 1C is the quadratus lumborum muscle which lies deep and originates from the iliac crest and runs superiorly to insert onto the last rib and transverse processes of the first four lumbar vertebrae. This muscle is located anterior-posterior midline and has no function concerning flexion, extension, or rotation. However, since it is lateral to the midline, this makes it effective during lateral bending.

Using said stretcher 1C allows one to correctly stabilize one's lower extremities, while applying torque to effectively lengthen these aforementioned muscles. This will result in an increase in flexibility and aid in injury prevention. Using said stretcher 1C after exercise or physical exertion will aid in recovery and allow one's lumbar region to relax at a faster rate.

Referring to FIGS. 26, 27, 28, 15, 17, and 19, said stretcher 1D includes a floor plate 401, the frame posts 404 (also referred to as uprights 404), the handle support frames 405 (also referred to as interconnecting frame members 405) with said apertures 405A, said handle assembly 410A, said handle assembly 410B, the vertical mount bar 420 (also referred to as intermediate upright 420), said handle assembly 430 with the hand grip 432, the first leg support 440 (also referred to as first hollow mounting bar 440), the second leg support 450 (also referred to as second hollow mounting bar 450), and the leg support roller assemblies 442 (also referred to as leg rest assemblies 442).

Said handle assembly 410A and said handle assembly 410B serve as arm extremity grips and, as previously mentioned as well as illustrated in FIG. 17, include the support frame positioning pin 411 (also referred to as locking pin 411), the frame positioning handle 412, and the handle support frame clearance 413 (also referred to as handle mounting sleeve). Each of said handle assemblies 410A and 410B is slidable along the handle support frames 405 and can be fixed in position with respect to the handle support frames 405 by means of said pins 411 in said apertures 405A in the handle support frames 405.

The preferred embodiment of said muscle stretcher 1D further comprises the first leg support 440 and the second leg support 450 which are supported by the vertical mount bar 420.

Said leg supports 440 and 450 are slideable with respect to the vertical mount bar 420 with vertical apertures 420A (Ref. FIG. 15) and can be fixed in a desired position by means of said positioning pins 441 and 451 (Ref. FIG. 15) which are insertable into said apertures 420A in the vertical mount bar 420.

Said handle assembly 430 with said pin 431 and said handle 432 is slideable up and down along the vertical mount bar 420 and is fixable in a given vertical location with respect to the vertical mount bar 420 by means of said positioning pin 431 being set into said apertures 420A in the vertical mount bar 420.

A human is illustrated using said stretcher 1D. The arm extremities, i.e. hands, are grasping said handles 412 of said handle assemblies 410A and 410B, each of which handles 412 serve extremity grips. One of the lower extremities is in positiong against one of said rollers 442. By a variety of combinations of pushing and pulling with the human's extremeties, a variety of stretching exercises can be completed.

A unique feature of said stretcher 1D, which is also true of said station 40, a human can have a knee under said roller 442 of the second leg support 450 with a foot hooked over said roller 442 of the first leg support 440 while stretching.

Said stretcher 1D can be used for stretches which comprise a hamstring stetch, an inner thigh stretch, a hip flexor stretch, a quadriceps stretch, and an advanced quadriceps stretch.

To perform the hamstring stretch, adjust the first leg support 440 to a desired height. Adjust said handle assemblies 410A, 410B, and 430 to a comfortable desired reach. Place an ankle on one of the leg support assemblies 442 of the first leg support 440 and grasp any two of said handle assemblies 410A, 410B, and 432. Then pull the body forward while keeping back foot planted firmly on the floor plate 401. To increase stretch, pull the body further forward, while maintaining form. This stretch affects flexion, extension, medial, and lateral rotation of the hip joint. The semimembranosus, semitendinosus, and biceps femoris. The inner thigh stretch will affect some of the muscles affected by the hamstring stretch.

To form the hip flexor stretch, adjust the second leg support 450 to a desired height. Adjust said handle assemblies 410 to a comfortable reach. Face away from the vertical mount bar 420. Hyperextend a hip and place leg, just above the knee, on one of the leg rest roller assemblies 442. Keep the forward leg planted firmly. Push upper body back towards said bar 420 by pushing off said handle assemblies 410A and 410B. To enhance the stretch, slightly flex the forward knee joint.

The hip joint is a ball and socket joint, similar to the shoulder. The hip joint has a range of approximately 15 degrees of hyperextension, which is the stretch range of this stretch.

The quadriceps stretch and the advanced quadriceps stretch affects the same muscles similarly. The instructions are different, but the end results are the same, and the benefits are similar.

To perform the quadriceps stretch, adjust the leg support 450 to a desired height. Adjust said handle assemblies 410A and 410B to a comfortable position to provide leverage. Face away from said bar 420 and position one's self approximately 18 inches from said bar 420. Place one of your feet on one of said roller assemblies 442. The front leg is placed on, and seated on the floor. Sit back on the heel of the leg being stretched and ben the forward knee slightly. While doing this, one pushes their body down and backwards by pushing off said handle assemblies 410A and 410B.

To perform the advanced quadriceps stretch, take the same stance as for the quadriceps stretch. With ankle in place, on top of one of said roller assemblies 442, place the front of the corresponding thigh on the second leg support 450 with the corresponding knee behind one of said roller assemblies 442. Push upper body back, while forcing the corresponding knee down.

The preferred material of construction is metal, preferably a structural steel, with the exception of padding 442A, which could be of plastic, rubber, or some textile construction.

Although the description above contains many specificities, these should not be construed as limiting the scope of the invention but as merely providing illustrations of some of the presently preferred embodiments of this invention.

It will be obvious to those skilled in the art that modifications may be made to the embodiments described above without departing from the scope of the present invention.

Thus the scope of the invention should be determined by the appended claims and their legal equivalents, rather than by the examples given.

I claim:

1. A muscle stretching apparatus, comprising:

a framework including first and second uprights;

a first handle assembly mounted on said first upright extending at an acute upward angle relative to said first upright; and a second handle assembly mounted on said second upright, said second handle assembly being L-shaped, including an extension leg and a gripping leg at substantially right angles to said extension leg, wherein said extension leg is mounted on said second upright and projects from said second upright toward said first upright.

2. A muscle stretching apparatus as recited in claim 1, wherein said gripping leg projects downwardly from said extension leg.

3. A muscle stretching apparatus as recited in claim 1, and further comprising first and second mounting sleeves which mount said first and second handles to said first and second uprights, respectively, wherein said mounting sleeves are slidably mounted over their respective uprights; and locking pins which extend through the respective mounting sleeves and uprights, locking the mounting sleeves on their respective uprights.

4. A muscle stretching apparatus, comprising:

a framework including first and second uprights;

a first handle assembly mounted on said first upright extending at an acute upward angle relative to said first upright;

a second handle assembly mounted on said second upright, said second handle assembly being L-shaped, including an extension leg and a gripping leg at substantially right angles to said extension leg, wherein said extension leg is mounted on said second upright and projects from said second upright toward said first upright;

first and second mounting sleeves which mount said first and second handles to said first and second uprights, respectively, wherein said mounting sleeves are slidably mounted over their respective uprights; and locking pins, which extend through the respective mounting sleeves and uprights, locking the mounting sleeves on their respective uprights;

wherein said second mounting sleeve defines a receptacle which receives said extension leg.

5. A muscle stretching apparatus as recited in claim 4, wherein said extension leg defines a plurality of adjustment holes, and said receptacle defines at least one receptacle hole; and further including an extension leg mounting pin, which extends through one of said adjustment holes and through said receptacle hole to fix said second handle relative to said second mounting sleeve, and wherein the distance from said gripping leg to said first upright is adjustable by sliding said extension leg relative to said receptacle and selecting the desired mounting hole through which to insert said extension leg mounting pin.

6. A muscle stretching apparatus, comprising:

a base;

a frame projecting upwardly relative to said base;

a plurality of extremity grips mounted on said frame; and an adjustable frame subassembly mounted on said frame, said subassembly including lever handles; an adjustment handle; and an adjustment handle positioning pin, wherein said adjustable frame subassembly is rotatable relative to said frame, and said lever handles can be rotated upwardly by an aide to provide additional stretching assistance; and including means for locking said subassembly in a given rotational orientation using said positioning pin.

7. A muscle stretching apparatus, comprising:

a base;

a frame including a left upright and a right upright;

an axle pivotably mounted on and extending between said left and right uprights;

first and second handles mounted on said axle; and means for locking said axle against rotation.

8. A muscle stretching apparatus, comprising:

a frame, including first and second uprights;

an axle extending between said uprights and rotatably mounted on said frame;

first and second spaced-apart handles mounted on and projecting radially from said axle; and means for selectively locking said axle against rotation.

9. A muscle stretching apparatus as recited in claim 8, wherein said first and second spaced-apart handles are substantially parallel to each other and are at least partially padded.

10. A muscle stretching apparatus, comprising:

a frame, including first and second uprights;

an axle extending between said uprights and rotatably mounted on said frame;

first and second spaced-apart handles mounted on and projecting radially from said axle; and means for selectively locking said axle against rotation;

wherein said first and second spaced-apart handles are substantially parallel to each other and are at least partially padded; and further comprising means for adjusting the height of said axle relative to said uprights.

11. A muscle stretching apparatus, comprising:

a frame, including first, second, third, and fourth uprights;

first and second substantially horizontal members interconnecting said first and third uprights and said second and fourth uprights, respectively;

first and second handles mounted on said first and second substantially horizontal
members, respectively;

a substantially horizontal seat intermediate said third and fourth uprights; and, at least a first leg brace mounted to one of said first and second uprights.

12. A muscle stretching apparatus as recited in claim 11, and further comprising:

a third substantially horizontal frame member interconnecting said third and fourth uprights; and, a third handle adjustably mounted to said third substantially horizontal frame member.

13. A muscle stretching apparatus as recited in claim 12, and further comprising:

a second leg brace mounted to the other of said first and second uprights;

a mounting sleeve on at least one of said first, second, and third handles, wherein said mounting sleeve is slidably mounted over its respective substantially horizontal member; and a locking pin extending through said mounting sleeve and its respective substantially horizontal member, locking the mounting sleeve on its respective substantially horizontal member.

14. A muscle stretching apparatus as recited in claim 13, and further comprising:

leg brace mounting receptacles affixed to said first and second uprights respectively, each of said leg brace mounting receptacles defining a receptacle hole, and wherein said first and second leg braces define first and second leg extensions, each of said leg extensions defining a plurality of adjustment holes; and further comprising first and second leg extension mounting pins, each of said leg extension mounting pins extending through one of said adjustment holes and through one of said receptacle holes so as to fix said first and second leg extensions relative to said leg brace mounting receptacles, and wherein the distance from said first and second leg braces to each other is adjustable by sliding said leg extensions relative to said leg brace mounting receptacles and selecting the desired adjustment holes through which to insert said leg extension mounting pins.

15. A muscle stretching apparatus, comprising:

a base;

a frame projecting upwardly relative to said base;

a plurality of extremity grips mounted on said frame; and at least one leg rest assembly mounted on said frame, including a hollow mounting bar defining an inner surface which slidably receives said frame; at least one padded roller mounted on said mounting bar; and a positioning pin which locks said hollow mounting bar in a fixed position on said frame.

16. A muscle stretching apparatus, comprising:

a frame, including first and second uprights and an intermediate upright between said first and second uprights;

first and second handles supported on said first and second uprights, respectively; and upper and lower rollers mounted on said intermediate upright, including means for adjusting the height of each of said rollers relative to said intermediate upright.

17. A muscle stretching apparatus, comprising:

a frame, including first, second, third, and fourth uprights and an intermediate upright between said first and second uprights;

first and second interconnecting frame members connecting said first and third uprights and said second and fourth uprights, respectively;

first and second handles mounted on said first and second interconnecting frame members, respectively; and at least one leg rest assembly mounted on said intermediate upright, including a hollow mounting bar defining an inner surface which slidably receives said intermediate upright; at least one padded roller mounted on said mounting bar; and a positioning pin which locks said hollow mounting bar in a fixed position on said intermediate upright.

18. A muscle stretching apparatus as recited in claim 17, and further comprising a third handle mounted on said intermediate upright.

19. A muscle stretching apparatus as recited in claim 17, wherein at least one of said handles includes a mounting sleeve which slidably receives its respective frame member, and further comprising a locking pin which extends through the respective mounting sleeve and interconnecting frame member, locking the mounting sleeve on its respective frame member.

* * * * *